US008894447B2

(12) United States Patent
Canning et al.

(10) Patent No.: US 8,894,447 B2
(45) Date of Patent: Nov. 25, 2014

(54) COMMUNICATION PLUG HAVING A PLURALITY OF COUPLED CONDUCTIVE PATHS

(71) Applicant: CommScope, Inc. of North Carolina, Hickory, NC (US)

(72) Inventors: Michael W. Canning, Plano, TX (US); Wayne D. Larsen, Wylie, TX (US); Richard A. Schumacher, Dallas, TX (US); Amid I. Hashim, Plano, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 8 days.

(21) Appl. No.: 13/802,856

(22) Filed: Mar. 14, 2013

(65) Prior Publication Data

US 2014/0273629 A1 Sep. 18, 2014

(51) Int. Cl.
*H01R 24/00* (2011.01)
*H01R 24/28* (2011.01)
*H01R 13/6461* (2011.01)

(52) U.S. Cl.
CPC ..... *H01R 13/6461* (2013.01); *H01R 24/28* (2013.01)
USPC ..... 439/676

(58) Field of Classification Search
USPC ..... 439/676, 941, 620.24
See application file for complete search history.

(56) References Cited

U.S. PATENT DOCUMENTS 6,099,345 A 8/2000 Milner et al.
7,179,131 B2 2/2007 Caveney et al.
7,182,649 B2 2/2007 Caveney et al.
7,252,554 B2 * 8/2007 Caveney et al. ..... 439/676
7,442,092 B2 * 10/2008 Caveney et al. ..... 439/676
7,670,193 B2 3/2010 Milette et al.
7,780,480 B2 8/2010 Caveney
7,837,513 B2 11/2010 Millette et al.
7,857,635 B2 12/2010 Goodrich et al.

(Continued)

FOREIGN PATENT DOCUMENTS

JP 2009-529764 A 8/2009

OTHER PUBLICATIONS

International Search Report and Written Opinion Corresponding to International Application No. PCT/US2014/020964; Date of Mailing: Jun. 23, 2014; 14 Pages.

*Primary Examiner* — Chandrika Prasad
(74) *Attorney, Agent, or Firm* — Myers Bigel Sibley & Sajovec, P.A.

(57) ABSTRACT

Patch cords include a communications cable that has a first conductor and a second conductor that form a first differential pair, and a third conductor and a fourth conductor that form a second differential pair and a plug that is attached to the communications cable. The plug includes a housing that receives the communications cable, first through fourth plug contacts that are within the housing, and a printed circuit board. The printed circuit board includes first through fourth conductive paths that connect the respective first through fourth conductors to respective ones of the first through fourth plug contacts. The plug further includes a first conductive shield that extends above a top surface of the printed circuit board that is disposed between the first differential pair and the second differential pair.

17 Claims, 10 Drawing Sheets

(56) References Cited

U.S. PATENT DOCUMENTS

| | | | | |
|---|---|---|---|---|
| 8,016,621 | B2 * | 9/2011 | Bopp et al. | 439/676 |
| 8,282,425 | B2 * | 10/2012 | Bopp et al. | 439/676 |
| 2006/0121788 | A1 | 6/2006 | Pharney | |
| 2010/0124855 | A1 | 5/2010 | Milette et al. | |
| 2011/0065322 | A1 | 3/2011 | Milette et al. | |
| 2011/0124219 | A1 | 5/2011 | Milette et al. | |
| 2011/0195592 | A1 | 8/2011 | Mcgrath et al. | |
| 2012/0100744 | A1 | 4/2012 | Bolouri-Saransar et al. | |
| 2012/0156932 | A1 * | 6/2012 | Straka et al. | 439/620.24 |
| 2012/0225584 | A1 | 9/2012 | Larsen et al. | |

* cited by examiner

COMMUNICATION PLUG HAVING A PLURALITY OF COUPLED CONDUCTIVE PATHS

FIELD OF THE INVENTION

The present invention relates generally to communications connectors and, more particularly, to communications plugs such as RJ-45 plugs that may support high data rate communications.

BACKGROUND

Many hardwired communications systems use plug and jack connectors to connect a communications cable to another communications cable or to computer equipment. By way of example, high speed communications systems routinely use such plug and jack connectors to connect computers, printers and other devices to local area networks and/or to external networks such as the Internet. FIG. 1 depicts a highly simplified example of such a hardwired high speed communications system that illustrates how plug and jack connectors may be used to interconnect a computer 11 to, for example, a network server 20.

As shown in FIG. 1, the computer 11 is connected by a cable 12 to a communications jack 15 that is mounted in a wall plate 19. The cable 12 is a patch cord that includes a communications plug 13, 14 at each end thereof. Typically, the cable 12 includes eight insulated conductors. As shown in FIG. 1, plug 14 is inserted into a cavity or "plug aperture" 16 in the front side of the communications jack 15 so that the contacts or "plug blades" of communications plug 14 mate with respective contacts of the communications jack 15. If the cable 12 includes eight conductors, the communications plug 14 and the communications jack 15 will typically each have eight contacts. The communications jack 15 includes a wire connection assembly 17 at the back end thereof that receives a plurality of conductors (e.g., eight) from a second cable 18 that are individually pressed into slots in the wire connection assembly 17 to establish mechanical and electrical connections between each conductor of the second cable 18 and a respective one of a plurality of conductive paths through the communications jack 15. The other end of the second cable 18 is connected to a network server 20 which may be located, for example, in a telecommunications closet. Communications plug 13 similarly is inserted into the plug aperture of a second communications jack (not pictured in FIG. 1) that is provided in the back of the computer 11. Thus, the patch cord 12, the cable 18 and the communications jack 15 provide a plurality of electrical paths between the computer 11 and the network server 20. These electrical paths may be used to communicate information signals between the computer 11 and the network server 20.

When a signal is transmitted over a conductor (e.g., an insulated copper wire) in a communications cable, electrical noise from external sources may be picked up by the conductor, degrading the quality of the signal. In order to counteract such noise sources, the information signals in the above-described communications systems are typically transmitted between devices over a pair of conductors (hereinafter a "differential pair" or simply a "pair") rather than over a single conductor. The two conductors of each differential pair are twisted tightly together in the communications cables and patch cords so that the eight conductors are arranged as four twisted differential pairs of conductors. The signals transmitted on each conductor of a differential pair have equal magnitudes, but opposite phases, and the information signal is embedded as the voltage difference between the signals carried on the two conductors of the pair. When the signal is transmitted over a twisted differential pair of conductors, each conductor in the differential pair often picks up approximately the same amount of noise from these external sources. Because the information signal is extracted by taking the difference of the signals carried on the two conductors of the differential pair, the subtraction process may mostly cancel out the noise signal, and hence the information signal is typically not disturbed.

Referring again to FIG. 1, it can be seen that a series of plugs, jacks and cable segments connect the computer 11 to the server 20. Each plug, jack and cable segment includes four differential pairs, and thus a total of four differential transmission lines are provided between the computer 11 and the server 20 that may be used to carry two-way communications therebetween (e.g., two of the differential pairs may be used to carry signals from the computer 11 to the server 20, while the other two may be used to carry signals from the server 20 to the computer 11). The cascaded plugs, jacks and cabling segments shown in FIG. 1 that provide connectivity between two end devices (e.g., computer 11 and server 20) is referred to herein as a "channel." Thus, in most high speed communications systems, a "channel" includes four differential pairs. Unfortunately, the proximities of the conductors and contacting structures within each plug-jack connection (e.g., where plug 14 mates with jack 15) can produce capacitive and/or inductive couplings. These capacitive and inductive couplings in the connectors (and similar couplings that may arise in the cabling) give rise to another type of noise that is known as "crosstalk."

In particular, "crosstalk" refers to unwanted signal energy that is capacitively and/or inductively coupled onto the conductors of a first "victim" differential pair from a signal that is transmitted over a second "disturbing" differential pair. The induced crosstalk may include both near-end crosstalk (NEXT), which is the crosstalk measured at an input location corresponding to a source at the same location (i.e., crosstalk whose induced voltage signal travels in an opposite direction to that of an originating, disturbing signal in a different path), and far-end crosstalk (FEXT), which is the crosstalk measured at the output location corresponding to a source at the input location (i.e., crosstalk whose signal travels in the same direction as the disturbing signal in the different path). Both types of crosstalk comprise an undesirable noise signal that interferes with the information signal that is transmitted over the victim differential pair.

While methods are available that can significantly reduce the effects of crosstalk within communications cable segments, the communications connector configurations that were adopted years ago—and which still are in effect in order to maintain backward compatibility—generally did not arrange the contact structures so as to minimize crosstalk between the differential pairs in the connector hardware. For example, pursuant to the ANSI/TIA-568-C.2 standard approved Aug. 11, 2009 by the Telecommunications Industry Association, in the connection region where the contacts of a modular plug mate with the contacts of the modular jack (referred to herein as the "plug-jack mating region"), the eight contacts 1-8 of the jack must be aligned in a row, with the eight contacts 1-8 arranged as four differential pairs specified as depicted in FIG. 2. As known to those of skill in the art, under the TIA/EIA 568 type B configuration, contacts 4 and 5 in FIG. 2 comprise pair 1, contacts 1 and 2 comprise pair 2, contacts 3 and 6 comprise pair 3, and contacts 7 and 8 comprise pair 4. As is apparent from FIG. 2, this arrangement of the eight contacts 1-8 will result in unequal coupling between the differential pairs, and hence both NEXT and FEXT is introduced in each connector in industry standardized communications systems.

As hardwired communications systems have moved to higher frequencies in order to support increased data rate communications, crosstalk in the plug and jack connectors has became a more significant problem. To address this problem, communications jacks now routinely include crosstalk compensation circuits that introduce compensating crosstalk that is used to cancel much of the "offending" crosstalk that is introduced in the plug-jack mating region as a result of the industry-standardized connector configurations. Typically, so-called "multi-stage" crosstalk compensation circuits are used. Such crosstalk circuits are described in U.S. Pat. No. 5,997,358 to Adriaenssens et al., the entire content of which is hereby incorporated herein by reference as if set forth fully herein.

Another important parameter in communications connectors is the return loss that is experienced along each differential pair (i.e., differential transmission line) through the connector. The return loss of a transmission line is a measure of how well the transmission line is impedance matched with a terminating device or with loads that are inserted along the transmission line. In particular, the return loss is a measure of the signal power that is lost due to signal reflections that may occur at discontinuities (impedance mismatches) in the transmission line. Return loss is typically expressed as a ratio in decibels (dB) as follows:

$$RL(\text{dB}) = 10\log_{10}\frac{P_i}{P_r}$$

where RL(dB) is the return loss in dB, $P_i$ is the incident power and $P_r$ is the reflected power. High return loss values indicate a good impedance match (i.e., little signal loss due to reflection), which results in lower insertion loss values, which is desirable.

SUMMARY

Pursuant to embodiments of the present invention, patch cords are provided that include a communications cable that has a first conductor and a second conductor that form a first differential pair, and a third conductor and a fourth conductor that form a second differential pair and a plug that is attached to the communications cable. The plug includes a housing that receives the communications cable, first through fourth plug contacts that are within the housing, and a printed circuit board. The printed circuit board includes first through fourth conductive paths that connect the respective first through fourth conductors to respective ones of the first through fourth plug contacts. The plug further includes a first conductive shield that extends above a top surface of the printed circuit board that is disposed between the first differential pair and the second differential pair.

In some embodiments, the communications cable further includes a fifth conductor and a sixth conductor that form a third differential pair, and a seventh conductor and an eighth conductor that form a fourth differential pair. In such embodiments, the plug may further include a second conductive shield that extends below a bottom surface of the printed circuit board and that is disposed between the third differential pair and the fourth differential pair. In such embodiments, the first through fourth conductors may terminate into the top side of the printed circuit board and the fifth through eighth conductors may terminate into the bottom side of the printed circuit board.

In some embodiments, the plug may also include a conductive crosstail that is mounted in a back end of the housing, where the conductive crosstail includes a first fin that forms the first shield, a second fin that forms the second shield, along with a third fin and a fourth fin. A notch may be provided in a back edge of the printed circuit board, and the conductive crosstail may be received within the notch so that the first fin of the crosstail forms the first shield that extends above the top surface of the printed circuit board and the second fin of the crosstail forms the second shield that extends below the bottom surface of the printed circuit board. The first fin and the second fin may extend farther forwardly in the housing than do the third fin and the fourth fin. The third fin and the fourth fin may each include a widened section adjacent the printed circuit board.

In some embodiments, a thickness of the printed circuit board may be approximately equal to the thickness of the third fin plus twice the thickness of an insulation layer on the first conductor. In other embodiments, the thickness of the printed circuit board may be approximately equal to the thickness of the third fin plus twice the thickness of an insulation layer on the first conductor plus twice the thickness of a shield that surrounds the first and second conductors.

Pursuant to embodiments of the present invention, communications plugs are provided that include first through fourth conductive paths that electrically connect respective first through fourth inputs of the plug to respective first through fourth outputs of the plug. The first and second conductive paths comprise a first differential pair of conductive paths for transmitting a first information signal, and the third and fourth conductive paths comprise a second differential pair of conductive paths for transmitting a second information signal. A first section of the first conductive path and a second section of the second conductive path are configured to have generally the same instantaneous current direction and are positioned to both capacitively and inductively couple with each other.

In some embodiments, the amount of capacitive coupling may be at least half the amount of the inductive coupling. Moreover, the plug may further include a flexible printed circuit board, and the first section of the first conductive path may be on a first side of the flexible printed circuit board and the second section of the second conductive path may be on a second side of the flexible printed circuit board that is opposite the first side.

In some embodiments, the ratio of the capacitive coupling between first section of the first conductive path and the second section of the second conductive path to the inductive coupling between first section of the first conductive path and the second section of the second conductive path may be selected to provide a local maximum in a return loss spectrum for the first differential pair of conductive paths. Additionally, a third section of the third conductive path and a fourth section of the fourth conductive path may be configured to have generally the same instantaneous current direction and may be positioned to both capacitively and inductively couple with each other.

Pursuant to embodiments of the present invention, communications plugs are provided that include a housing having a plug aperture, a flexible printed circuit board that is at least partly mounted within the housing, and first and second conductive paths that electrically connect first and second inputs of the plug to respective first and second outputs of the plug. The first conductive path includes first and second conductive trace sections on the flexible printed circuit board that are immediately adjacent to each other and that have generally the same instantaneous current direction such that the first and second conductive trace sections self-couple and cause a localized increase in inductance. The first conductive trace section is on a first side of the flexible printed circuit board and the second conductive trace section is on a second side of the flexible printed circuit board that is opposite the first side, and the first and second conductive trace sections are configured to both inductively and capacitively couple with each other.

In some embodiments, the first conductive trace section comprises a spiral. This spiral may at least partially overlap the second conductive trace section. An amount of capacitive coupling between the first conductive trace section and the second conductive trace section may be at least half an amount of inductive coupling between the first conductive trace section and the second conductive trace section.

Pursuant to embodiments of the present invention, RJ-45 communications plugs are provided that include a housing, a printed circuit board within the housing and a lossy dielectric material between at least one side of the printed circuit board and the housing. In some embodiments, the lossy dielectric material may be a carbon loaded foam. The lossy dielectric material may be injected within the housing, and may comprise a curable material. The lossy dielectric material may substantially fill the open area within the housing.

Pursuant to embodiments of the present invention, patch cords are provided that include a communications cable that includes eight conductors that are arranged as four differential pairs of conductors and a plug that is attached to the communications cable. The plug includes a housing that receives the communications cable, the housing having a front surface, a top surface and a bottom surface and a plurality of slots that each have a front portion that extends along the front surface and a top portion that extends along the top surface. A printed circuit board is at least partially mounted within the housing and includes eight conductive paths that are electrically connected to the respective eight conductors of the communications cable. Eight plug blades that are electrically connected to the respective eight conductive paths on the printed circuit board, each of the plug blades having a front surface that is exposed by the front portion of a respective one of the slots and a top portion that is exposed by the top portion of the respective slot. A top surface of the printed circuit board defines an oblique angle with a plane defined by the top surfaces of the eight plug blades.

In some embodiments, at least some of the plug blades comprise skeletal plug blades. All eight conductors of the communications cable may be terminated into the same side of the printed circuit board. In some embodiments, a front portion of the printed circuit board may be angled towards the bottom surface of the housing, and the eight conductors of the communications cable may be terminated into a bottom side of the printed circuit board. In other embodiments, the front portion of the printed circuit board may be angled towards the top surface of the housing, and the eight conductors of the communications cable may be terminated into a top side of the printed circuit board. At least two of the conductors may terminate into a front half of the printed circuit board and at least four of the conductors may terminate into a back half of the printed circuit board.

Pursuant to embodiments of the present invention, communications plugs are provided that include a housing, a flexible printed circuit board mounted in the housing, the flexible printed circuit board having a first conductive path and a second conductive path that form a first differential pair of conductive paths and a third conductive path and a fourth conductive path that form a second differential pair of conductive paths. First through fourth plug contacts are electrically connected to the respective first through fourth conductive paths. A section of the first conductive path is on a first side of the flexible printed circuit board and a section of the third conductive path is on a second, opposite side of the flexible printed circuit board and are configured to both inductively and capacitively couple.

In some embodiments, the section of the first conductive path and the section of the third conductive path may partially overlap but may not completely overlap. The amount of capacitive coupling between the section of the first conductive path and the section of the third conductive path may be at least half an amount of inductive coupling between the section of the first conductive path and the section of the third conductive path.

DETAILED DESCRIPTION

Figure 1:
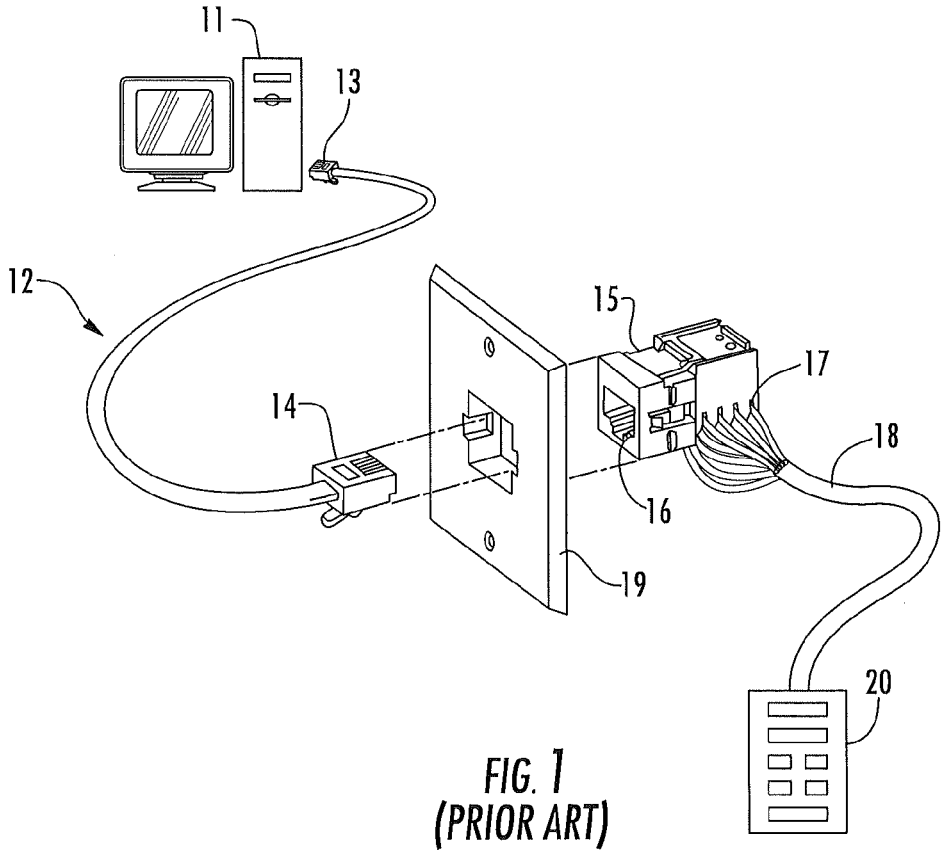
FIG. 1 (PRIOR ART)
FIG. 1 is a simplified schematic diagram illustrating the use of conventional communications plugs and jacks to interconnect a computer with network equipment.
Figure 2:
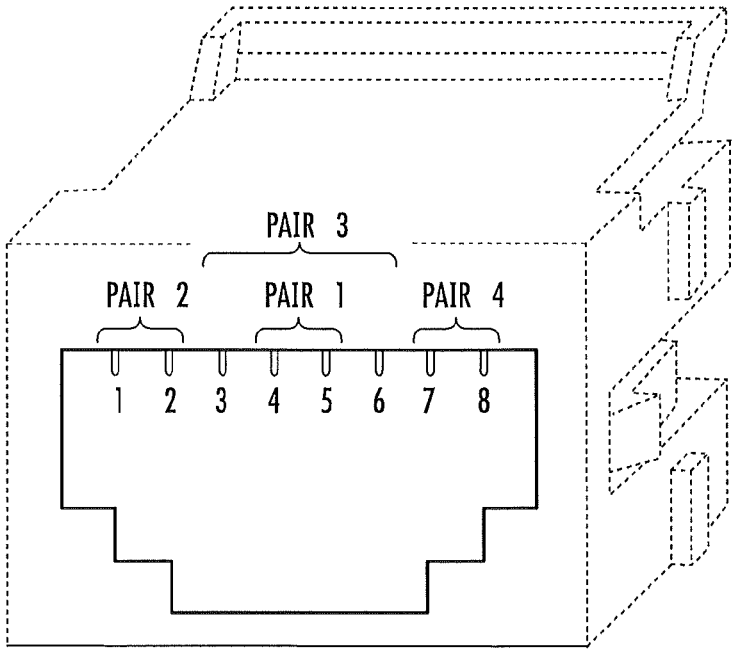
FIG. 2 (PRIOR ART)
FIG. 2 is a schematic diagram illustrating the TIA 568B modular jack contact wiring assignments for a conventional 8-position communications jack as viewed from the front opening of the jack.

The present invention is directed to communications plugs such as RJ-45 plugs. As used herein, the terms "forward" and "front" and derivatives thereof refer to the direction defined by a vector extending from the center of the plug toward the portion of the plug that is first received within a plug aperture of a jack when the plug is mated with a jack. Conversely, the terms "rearward" and "back" and derivatives thereof refer to the direction directly opposite the forward direction. The forward and rearward directions define the longitudinal dimension of the plug. The vectors extending from the center of the plug toward the respective sidewalls of the plug housing defines the transverse (or lateral) dimension of the plug. The transverse dimension is normal to the longitudinal dimension. The vectors extending from the center of the plug toward the respective top and bottom walls of the plug housing (where the top wall of the plug housing is the wall that includes slots that expose the plug blades) defines the vertical dimension of the plug. The vertical dimension of the plug is normal to both the longitudinal and transverse dimensions.

Pursuant to embodiments of the present invention, communications plugs, as well as patch cords that include such communications plugs, are provided that may support high data rate communications. Some embodiments of these patch cords/plugs may operate at frequencies supporting 40 gigabit communications.

In some embodiments, the communications plug may include a printed circuit board that is used to electrically connect each conductor of a communications cable to a corresponding plug blade of the plug. Conductive shields may be provided that extend above and/or below the printed circuit board that reduce coupling between at least a first pair of the conductors of the cable and a second pair of the conductors of the cable in the region where the conductors are terminated into the printed circuit board. In some embodiments, the conductive shields may comprise a pair of vertical fins on a metal-plated conductor-organizing crosstail that extend above and below the back portion of the printed circuit board. The thickness of the printed circuit board may be matched to the pitch of the bare conductors that extend from the crosstail onto the printed circuit board.

In some embodiments, the communications plugs include a flexible printed circuit board. These flexible printed circuit boards may include one or more circuits that may be used to improve the return loss of one or more of the differential transmission lines through the plug. For example, in some embodiments, the differential transmission lines may be configured so that the two conductive paths thereof both inductively and capacitively couple. These couplings may create resonances, and the resonances may be selected so that the return loss of the transmission line may be improved in a selected frequency range. In other embodiments, one or both conductive paths of the differential transmission line may be arranged so as to self-couple both inductively and capacitively to generate such resonances. High amounts of inductive and capacitive coupling may be generated by running the two conductive paths of the differential pair (or a single conductive path that is routed to self-couple) on opposite sides of the flexible printed circuit board.

In embodiments that include flexible printed circuit boards, high levels of offending inductive crosstalk may be generated by routing the traces associated with two different differential transmission lines on opposite sides of the flexible printed circuit board in an overlapping arrangement. As the dielectric layer of flexible printed circuit boards may be very thin (e.g., 1 mil), very high amounts of offending inductive crosstalk may be generated in a very short distance. This may facilitate injecting the offending inductive crosstalk closer to the plug-jack mating point, which may make the offending crosstalk easier to cancel in a mating jack.

In still further embodiments, RJ-45 plugs are provided that include a printed circuit board that is mounted at an angle within the plug housing. By angling the printed circuit board, increased space may be provided so that more than four of the conductors of the cable may be terminated into one side of the printed circuit board. In some embodiments, the plug blades are mounted on a top side of the printed circuit board, and the printed circuit board is angled within the housing so that all eight conductors of the cable can be terminated into the bottom side of the printed circuit board.

In yet further embodiments, communications plugs are provided which have a lossy dielectric injected into a housing thereof. The lossy dielectric may be a liquid or a foam, and may be cured by exposure to air, heat, ultraviolet light or the like so that it hardens into a solid material. The lossy dielectric may convert electric fields that emanate from the differential transmission lines within the plug into heat, thereby potentially reducing differential-to-differential crosstalk, differential-to-common mode crosstalk and alien crosstalk.

Embodiments of the present invention will now be discussed in greater detail with reference to the drawings.

Figure 3:
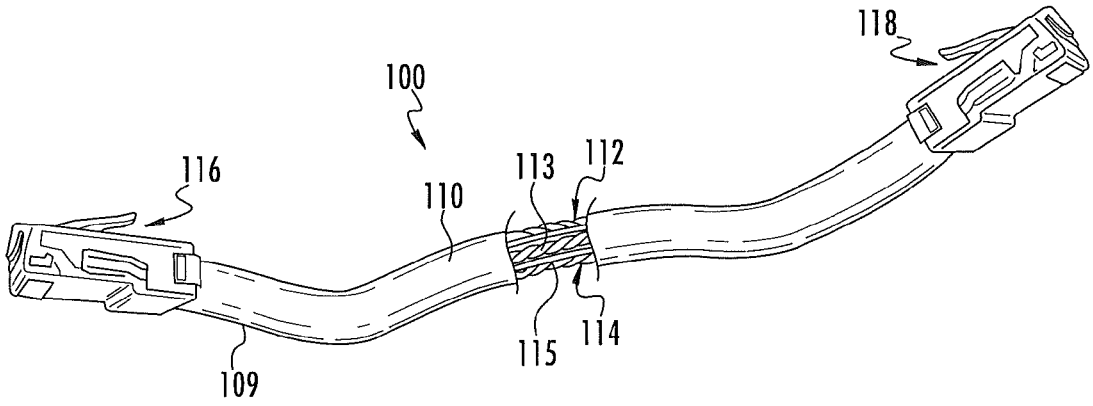
FIG. 3 is a perspective view of a patch cord according to certain embodiments of the present invention.
Figure 4:
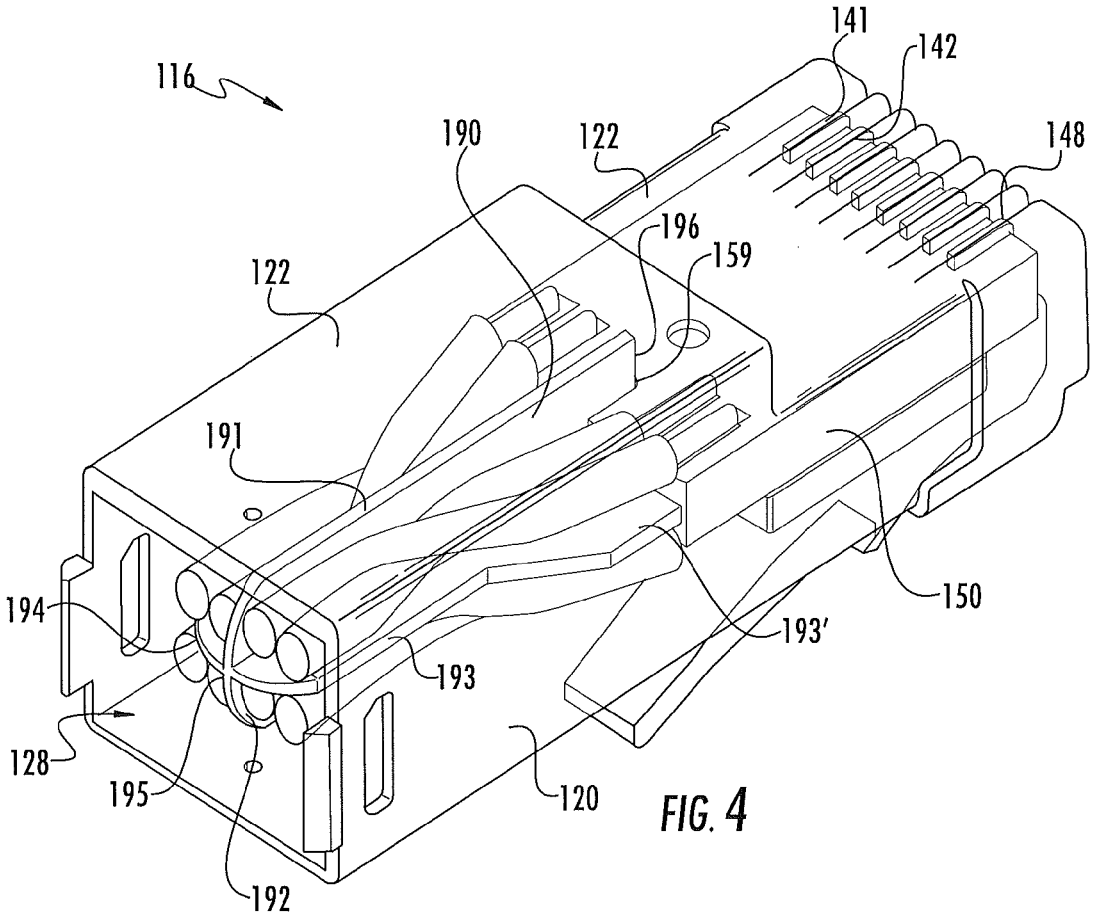
FIG. 4 is a top, rear perspective view of a plug that is included on the patch cord of FIG. 3.
Figure 5:
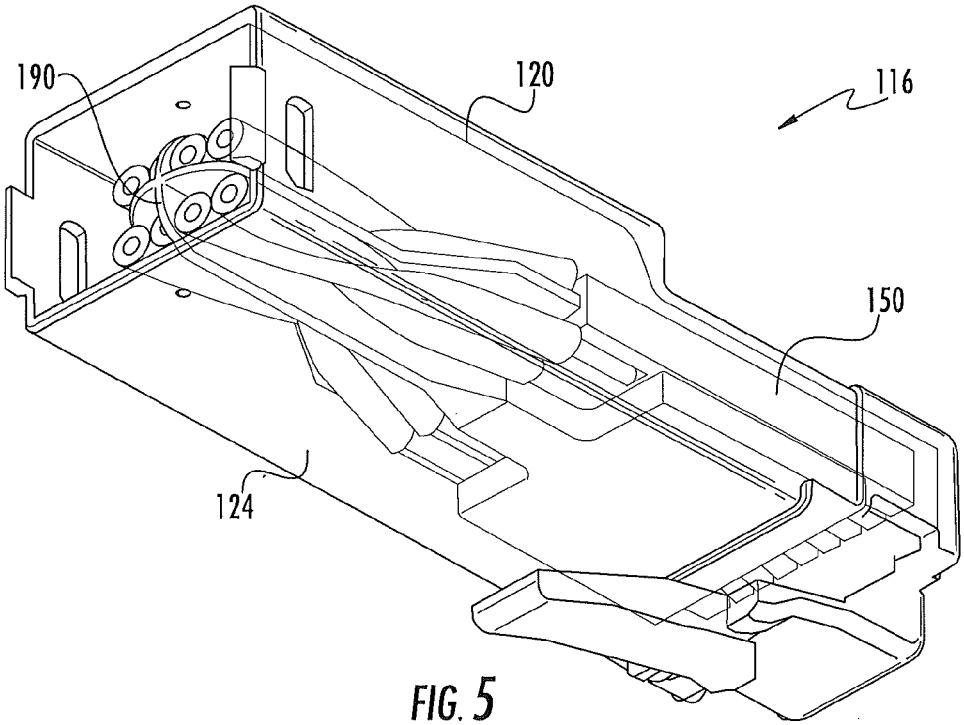
FIG. 5 is a bottom, rear perspective view of the plug of FIG. 4.
Figure 6:
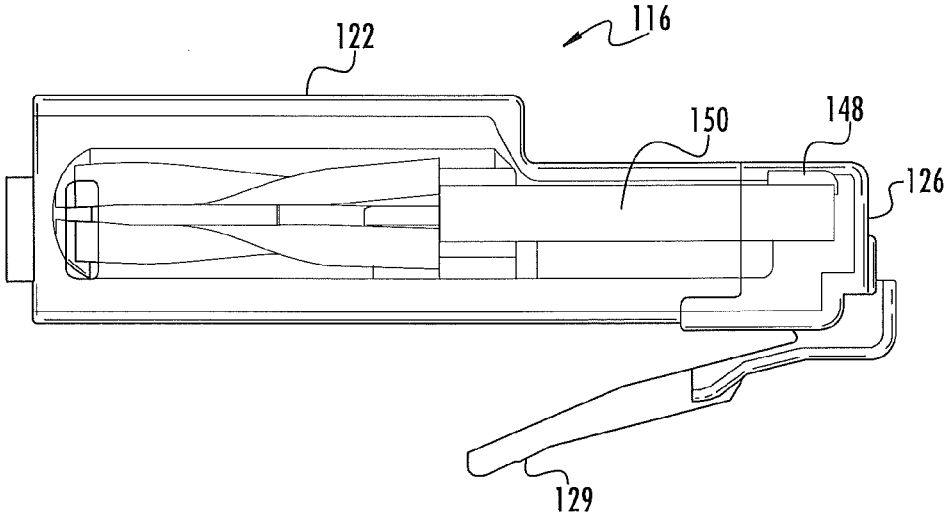
FIG. 6 is a side view of the plug of FIG. 4.

FIGS. 3-11 illustrate a patch cord 100 and various components thereof according to certain embodiments of the present invention. In particular, FIG. 3 is a perspective view of the patch cord 100. FIG. 4 is a top, rear perspective view of a plug 116 that is included on the patch cord 100 of FIG. 3, FIG. 5 is a bottom, rear perspective view of the plug 116. FIG. 6 is a side view of the plug 116. FIGS. 7-10 are various perspective views of the plug contacts 141-148 and a printed circuit board 150 of plug the 116 of FIGS. 4-6.

As shown in FIG. 3, the patch cord 100 includes a cable 109 that has eight insulated conductors 101-108 enclosed in a jacket 110 (the conductors 101-103 and 106-108 are not individually numbered in FIG. 3, and conductors 104 and 105 are not visible in FIG. 3). The insulated conductors 101-108 may be arranged as four twisted pairs of conductors, with conductors 104 and 105 twisted together to form twisted pair 111 (pair 111 is not visible in FIG. 3), conductors 101 and 102 twisted together to form twisted pair 112, conductors 103 and 106 twisted together to form twisted pair 113, and conductors 107 and 108 twisted together to form twisted pair 114. A separator 115 such as a tape separator or a cruciform separator may be provided that separates one or more of the twisted pairs 111-114 from one or more of the other twisted pairs 111-114. A first plug 116 is attached to a first end of the cable 109 and a second plug 118 is attached to the second end of the cable 109 to form the patch cord 100.

FIGS. 4-6 are enlarged views that illustrate the first plug 116 of the patch cord 100. A rear cap of the plug housing and various wire grooming and wire retention mechanisms are omitted to simplify these drawings. As shown in FIGS. 4-6, the communications plug 116 includes a housing 120 that has a bi-level top face 122, a bottom face 124, a front face 126, and a rear opening 128 that receives a rear cap (not shown). A plug latch 129 extends from the bottom face 124. The top and front faces 122, 126 of the housing 120 include a plurality of longitudinally extending slots. The communications cable 109 (see FIG. 3) is received through the rear opening 128. The rear cap (not shown) locks into place over the rear opening 128 of housing 120 and includes an aperture that receives the communications cable 109.

As is also shown in FIGS. 4-6, the communications plug 116 further includes a printed circuit board 150 which is disposed within the housing 120, and a plurality of plug contacts 141-148 in the form of low profile plug blades that are mounted at the forward edge of the printed circuit board 150. The top and front surfaces of the plug blades 141-148 are exposed through the slots in the top face 122 and front face 126 of the housing 120. The housing 120 may be made of an insulative plastic material that has suitable electrical breakdown resistance and flammability properties such as, for example, polycarbonate, ABS, ABS/polycarbonate blend or other dielectric molded materials. Any conventional housing 120 may be used that is configured to hold the printed circuit board 150.

Figure 7:
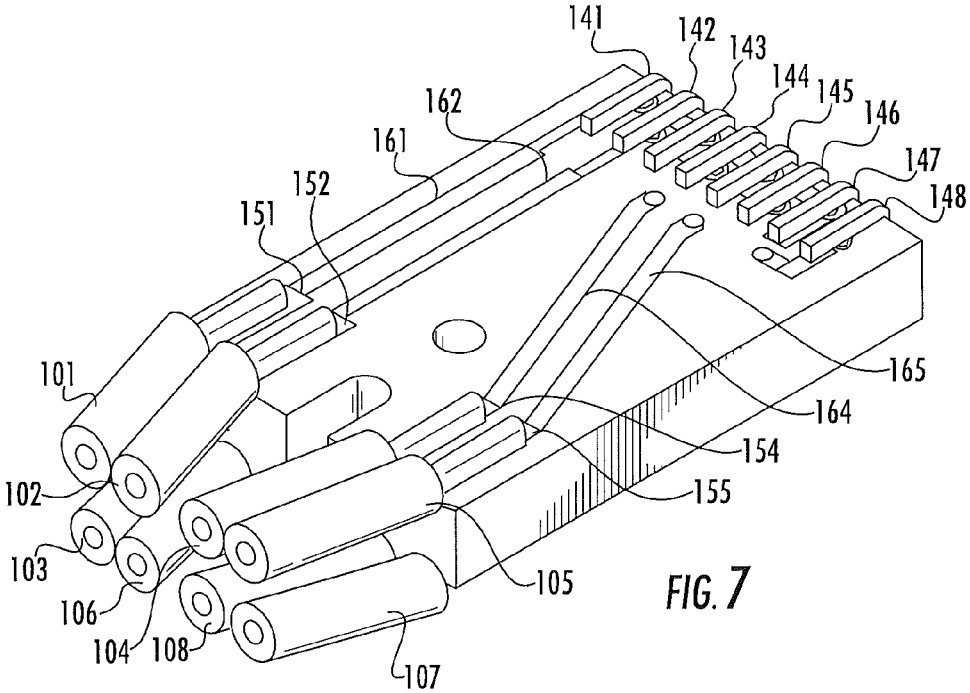
FIGS. 7-10 are various perspective views of the plug contacts and a printed circuit board of the plug of FIGS. 4-6.
Figure 8:
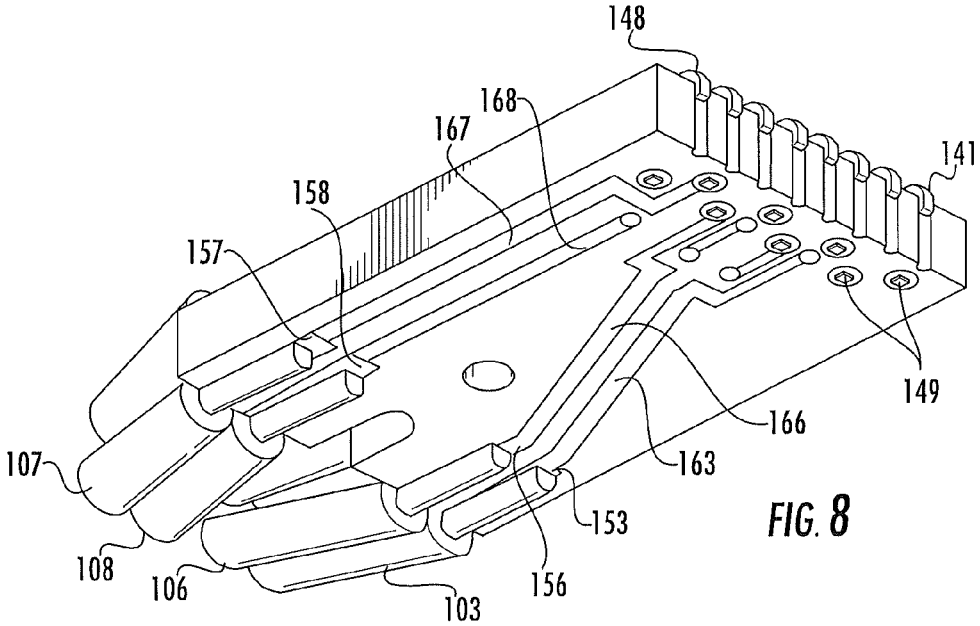
Figure 9:
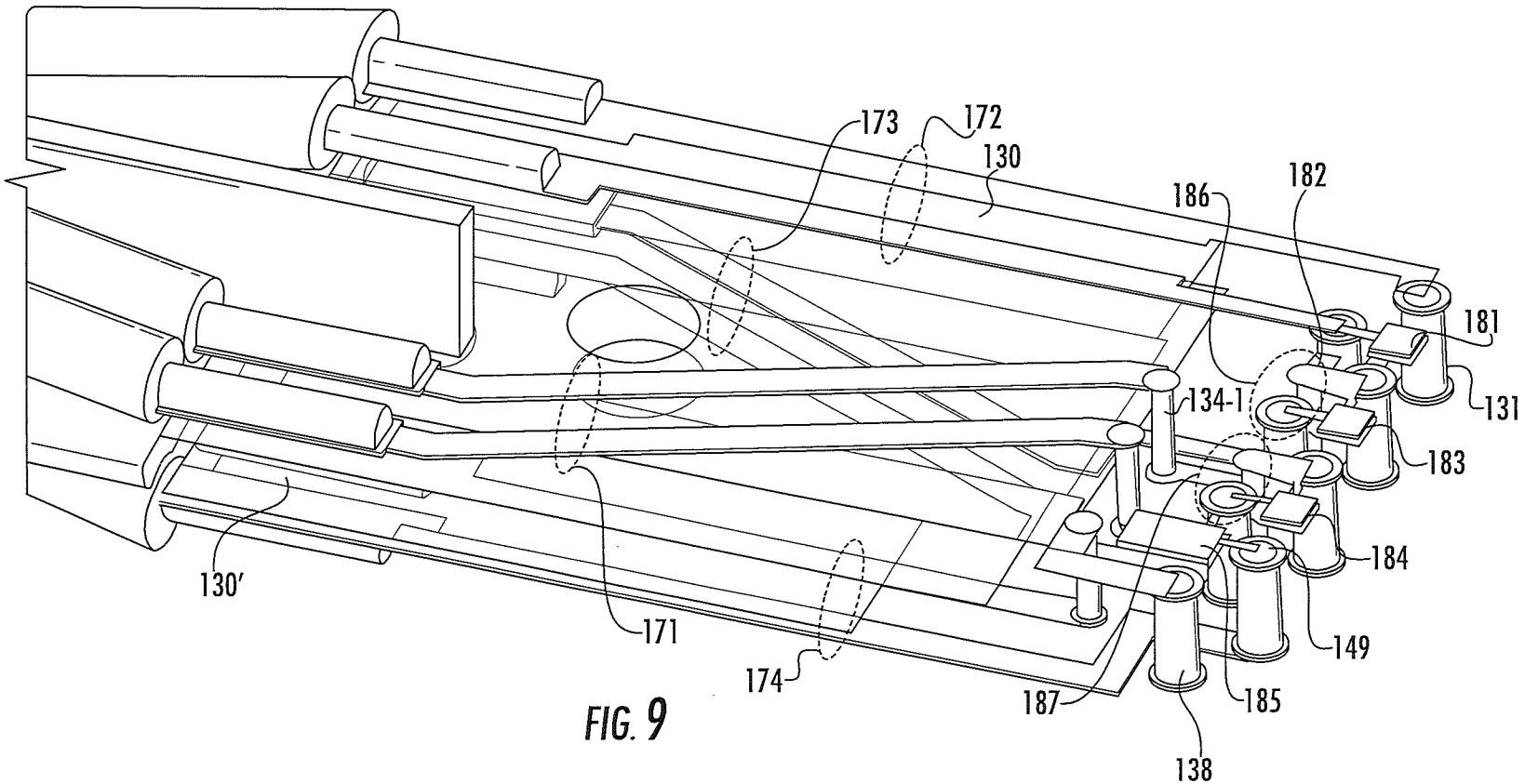
Figure 10:
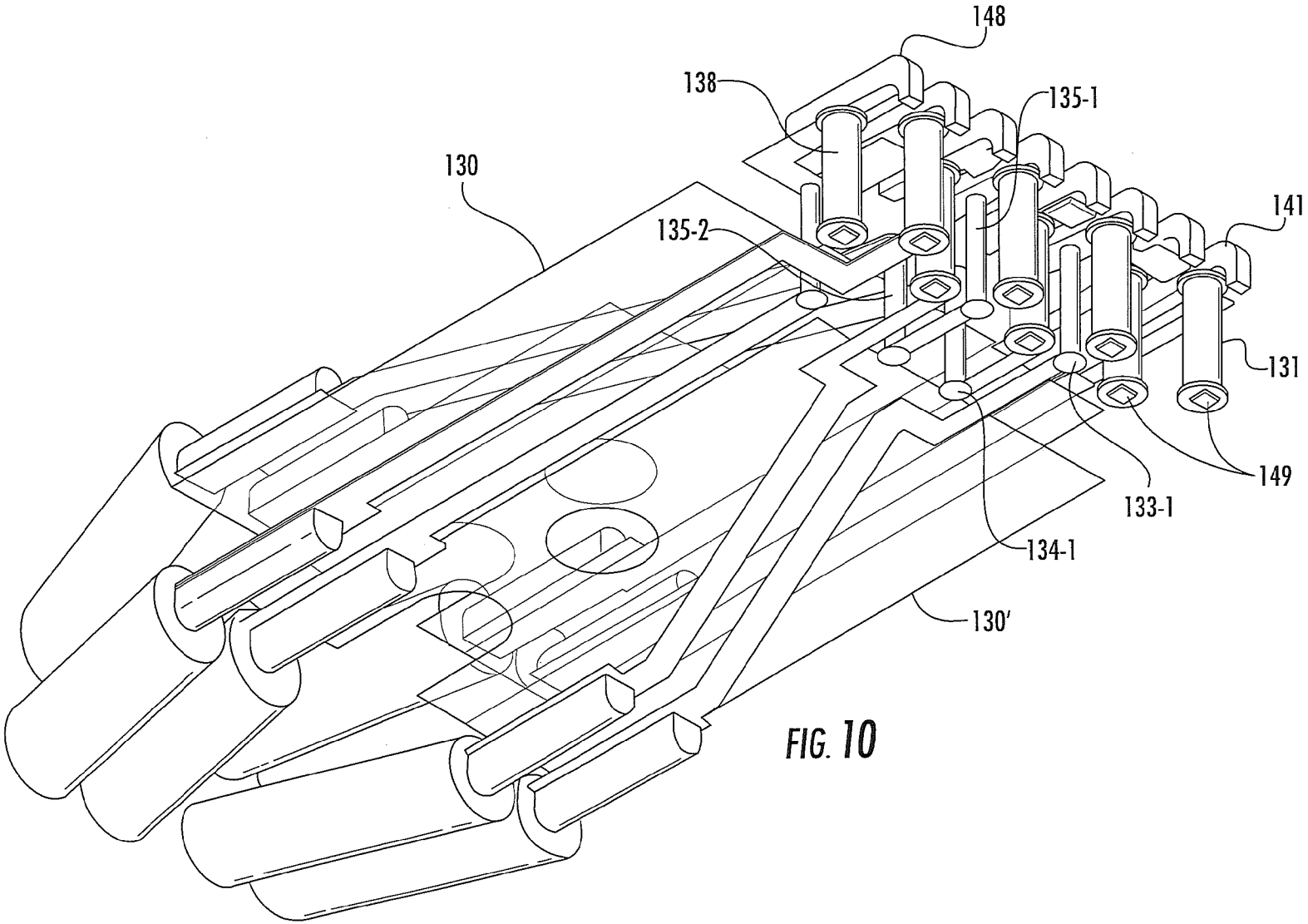

FIGS. 7 and 8 are enlarged perspective top and bottom views, respectively, of the printed circuit board 150 and the plug blades 141-148 that illustrate these structures in greater detail and that show how the conductors 101-108 of communications cable 109 may be electrically connected to the respective plug blades 141-148 through the printed circuit board 150. FIGS. 9 and 10 are enlarged perspective top and bottom views, respectively, of the top and bottom surfaces of the printed circuit board 150 and the plug blades 141-148. In FIGS. 9 and 10, the dielectric portion of the printed circuit board 150 is omitted in order to better illustrate certain features of the printed circuit board 150. In FIG. 9, only the downwardly extending projections 149 of the plug blades 141-148 are shown in order to better illustrate various offending crosstalk circuits that are included in the plug 116.

The printed circuit board 150 may comprise, for example, a conventional printed circuit board, a specialized printed circuit board (e.g., a flexible printed circuit board) or any other appropriate type of wiring board. In the embodiment of the present invention depicted in FIGS. 3-10, the printed circuit board 150 comprises a conventional multi-layer printed circuit board.

As shown in FIGS. 7-10, the printed circuit board 150 includes four plated pads 151, 152, 154, 155 on a top surface thereof and four plated pads 153, 156-158 on a bottom surface thereof. The insulation is removed from an end portion of each of the conductors 101-108, and the metal (e.g., copper) core of each conductor 101-108 may be soldered, welded or otherwise attached to a respective one of the plated pads 151-158. By terminating each of the conductors 101-108 directly onto the plated pads 151-158 without the use of any insulation piercing contacts, the size of the plug 116 may be reduced. However, it will be appreciated that other techniques may be used for terminating the conductors 101-108 to the printed circuit board 150. It will also be appreciated that in other embodiments different numbers of the conductors 101-108 may be mounted on the top and bottom surfaces of the printed circuit board 150 (e.g., all eight on one surface, six on one surface and two on another surface, etc.).

The conductors 101-108 may be maintained in pairs within the plug 116. A cruciform separator or "crosstail" 190 may be included in the rear portion of the housing 120 that separates each pair 111-114 from the other pairs 111-114 in the cable 109 to reduce crosstalk in the plug 116. The conductors 101-108 of each pair 111-114 may be maintained as a twisted pair all of the way from the rear opening 128 of plug 116 up to the back edge of the printed circuit board 150.

The plug blades 141-148 are configured to make mechanical and electrical contact with respective contacts, such as, for example, spring jackwire contacts, of a mating communications jack. Each of the eight plug blades 141-148 is mounted at the front portion of the printed circuit board 150. The plug blades 141-148 may be substantially aligned in a side-by-side relationship along the transverse dimension. Each of the plug blades 141-148 includes a first section that extends forwardly (longitudinally) along a top surface of the printed circuit board 150, a transition section that curves through an angle of approximately ninety degrees and a second section that extends downwardly from the first section along a portion of the front edge of the printed circuit board 150. The portion of each plug blade 141-148 that is in physical contact with a contact structure (e.g., a jackwire contact) of a mating jack during normal operation is referred to herein as the "plug-jack mating point" of the plug contact 141-148.

In some embodiments, each of the plug blades 141-148 may comprise, for example, an elongated metal strip having a length of approximately 140 mils, a width of approximately 20 mils and a height (i.e., a thickness) of approximately 20 mils. Each plug blade 141-148 may optionally include a projection 149 that extends downwardly from the bottom surface of the first section of the plug blade (see FIG. 9). The printed circuit board 150 includes eight metal-plated vias 131-138 that are arranged in two rows along the front edge thereof. The projections 149 of each plug blade 141-148 is received within a respective one of the metal-plated vias 131-138 where it may be press-fit, welded or soldered into place to mount the plug blades 141-148 on the printed circuit board 150. In some embodiments, the projections 149 may be omitted and the plug blades 141-148 may be soldered or welded directly onto their respective vias 131-138 or soldered/welded onto respective ones of conductive pads that are deposited on top of the respective vias 131-138.

Turning again to FIGS. 7-10 it can be seen that a plurality of conductive paths 161-168 are provided on the top and bottom surfaces of the printed circuit board 150. Each of these conductive paths 161-168 electrically connects one of the plated pads 151-158 to a respective one of the metal-plated vias 131-138 so as to provide a conductive path between each of the conductors 101-108 that are terminated onto the plated pads 151-158 and a respective one of the plug blades 141-148 that are mounted in the metal-plated vias 131-138. Each conductive path 161-168 may comprise, for example, one or more conductive traces that are provided on one or more layers of the printed circuit board 150. When a conductive path 161-168 includes conductive traces that are on multiple layers of the printed circuit board 150 (i.e., conductive paths 163-165 and 168 in the depicted embodiment), metal-plated or metal-filled through holes (or other layer-transferring structures known to those skilled in this art) may be provided that provide an electrical connection between the conductive traces on different layers of the printed circuit board 150.

A total of four differential transmission lines 171-174 are provided through the plug 116. The first differential transmission line 171 includes the end portions of conductors 104 and 105, the plated pads 154 and 155, the conductive paths 164 and 165, the plug blades 144 and 145, and the metal-plated vias 134, 135. The second differential transmission line 172 includes the end portions of conductors 101 and 102, the plated pads 151 and 152, the conductive paths 161 and 162, the plug blades 141 and 142, and the metal-plated vias 131, 132. The third differential transmission line 173 includes the end portions of conductors 103 and 106, the plated pads 153 and 156, the conductive paths 163 and 166, the plug blades 143 and 146, and the metal-plated vias 133, 136. The fourth differential transmission line 174 includes the end portions of conductors 107 and 108, the plated pads 157 and 158, the conductive paths 167 and 168, the plug blades 147 and 148, and the metal-plated vias 137, 138. As shown in FIGS. 7-10, the two conductive traces 161-168 that form each of the differential transmission lines 171-174 are generally routed together, side-by-side, on the printed circuit board 150, which may provide improved impedance matching.

A plurality of offending crosstalk circuits are also included on the printed circuit board 150. "Offending" crosstalk arises in industry standardized RJ-45 plug-jack interface because of the unequal coupling that occurs between the four differential transmission lines through RJ-45 plugs and jacks in the plug-jack mating region of the plug contacts. In order to reduce the impact of this offending crosstalk, communications jacks were developed in the early 1990s that included circuits that introduced "compensating" crosstalk that was used to cancel much of the "offending" crosstalk that was being introduced in the plug-jack mating region. In order to ensure that plugs and jacks manufactured by different vendors will work well together, the industry standards specify amounts of offending crosstalk that must be generated between the various differential pair combinations in an RJ-45 plug for that plug to be industry-standards compliant. Thus, while it is now possible to manufacture RJ-45 plugs that exhibit much lower levels of offending crosstalk, it is still necessary to ensure that RJ-45 plugs inject the industry-standardized amounts of offending crosstalk between the differential pairs so that backwards compatibility will be maintained with the installed base of RJ-45 plugs and jacks.

The plug 116 includes printed circuit board mounted plug blades that are "low profile" plug blades in that the adjacent plug blades have much smaller facing surface areas. This may significantly reduce the amount of offending crosstalk that is generated between the various differential pair combinations in the plug 116 (as traditionally much of the offending crosstalk was generated due to capacitive coupling between adjacent plug blades). The terminations of the conductors 101-108 onto the printed circuit board 150 and the routings of the conductive paths 161-168 may also be designed to reduce or minimize the amount of offending crosstalk that is generated between the differential pairs 171-174. As a result, the amount of offending crosstalk that is generated in the plug 116 may be significantly less than the offending crosstalk levels specified in the relevant industry-standards documents. A plurality of offending crosstalk circuits thus are provided in plug 116 that inject additional offending crosstalk between the pairs in order to bring the plug 116 into compliance with these industry standards documents.

The above-described approach may be beneficial, for example, because if everything else is held equal, more effective crosstalk cancellation may generally be achieved if the offending crosstalk and the compensating crosstalk are injected very close to each other in time (as this minimizes the phase shift that occurs between the point(s) where the offending crosstalk is injected and the point(s) where the compensating crosstalk is injected). The plug 116 is designed to generate low levels of offending crosstalk in the back portion of the plug (i.e., in portions of the plug 116 that are at longer electrical delays from the plug-jack mating regions of the plug blades 141-148), and the offending crosstalk circuits are provided to inject the bulk of the offending crosstalk at very short delays from the plug-jack mating regions of the plug blades 141-148. This may allow for more effective cancellation of the offending crosstalk in a mating jack.

As shown in FIG. 9, five offending crosstalk capacitors 181-185 are provided adjacent the plug blades 141-148. Capacitor 181 injects offending crosstalk between plug blades 142 and 143 (i.e., between differential transmission lines 172 and 173), capacitor 182 injects additional offending crosstalk between plug blades 142 and 143, capacitor 183 injects offending crosstalk between plug blades 143 and 144 (i.e., between differential transmission lines 171 and 173), capacitor 184 injects offending crosstalk between plug blades 145 and 146 (i.e., also between differential transmission lines 171 and 173), and capacitor 185 injects offending crosstalk between plug blades 146 and 147 (i.e., between differential transmission lines 173 and 174). Each of the five offending crosstalk capacitors 181-185 are configured to inject the offending crosstalk at a location that is very near to the plug-jack mating region of each plug blade 141-148. In particular, the electrodes for each crosstalk capacitor 181-185 connect to the top edges of the conductive vias 132-137. Thus, the offending crosstalk that is generated by each offending crosstalk capacitor 181-185 is injected at the underside of the plug blades 142-147, directly opposite the plug-jack mating region of the respective plug blades (e.g., perhaps 20 mils from the plug-jack mating region of each plug blade).

Moreover, four conductive vias 133-1, 134-1, 135-1 and 135-2 are provided that are used to generated additional offending inductive crosstalk. In particular, conductive via 133-1 is used instead of conductive via 133 to transfer signals passing along conductive path 163 from the trace on the bottom side of printed circuit board 150 to the top side of the printed circuit board 150. Conductive via 133-1 is transversely aligned with conductive via 134. By moving the vertical signal-current carrying path for conductive path 163 rearwardly by using conductive via 133-1 instead of conductive via 133 for the current-carrying path, the vertical current-carrying path for conductive path 163 is moved closer to conductive via 134 and farther away from conductive via 135. The net effect of this change is to significantly increase the offending inductive crosstalk that is generated between differential transmission lines 171 and 173, as the currents flowing through conductive vias 133-1 and 134 will couple heavily (due to their close proximity). Thus, the conductive vias 133-1 and 134 together form a first offending crosstalk inductive coupling section 186 which generates offending inductive crosstalk between differential transmission lines 171 and 173.

In a similar fashion, conductive via 135-1 is used instead of conductive via 135 to transfer signals from the trace on the bottom side of printed circuit board 150 that is part of conductive path 165 to the top side of the printed circuit board 150. The additional conductive via 135-1 is transversely aligned with conductive via 136. The net effect of this change is to significantly increase the offending inductive crosstalk that is generated between differential transmission lines 171 and 173, as the currents flowing through conductive vias 135-1 and 136 will couple heavily (due to their close proximity). Thus, the conductive vias 135-1 and 136 together form a second offending crosstalk inductive coupling section 187 which generates offending inductive crosstalk between differential transmission lines 171 and 173.

The offending inductive crosstalk circuits 186, 187 inject the offending crosstalk relatively close to the plug-jack mating points on the plug blades 143-146 of differential transmission lines 171, 173. The offending inductive crosstalk is generated in the vertical conductive vias 133-1, 134, 135-1, 136 because higher levels of inductive coupling can generally be generated in the conductive via structures than can be generated, for example, through the use of inductively coupling side-by-side conductive traces on the printed circuit board 150. Two additional conductive vias 134-1 and 135-2 are provided through the printed circuit board 150. The conductive vias 134-1 and 135-2 are provided to transfer the conductive paths 164 and 165, respectively, from the top surface to the bottom surface of printed circuit board 150 so that current will flow through conductive vias 134 and 135-1, as is necessary for proper operation of the offending inductive crosstalk circuits 186, 187, and to also arrange the direction of current flow through conductive vias 134 and 135-1 relative to conductive vias 133-1 and 136 so that inductive coupling will occur between vias 133-1 and 134 and between vias 135-1 and 136. Additional offending inductive crosstalk is generated between differential transmission lines using conductive trace segments that are routed side-by-side on the printed circuit board 150.

As noted above, the plug 116 may be designed to mostly inject the industry standardized levels of offending crosstalk between the differential transmission lines at locations close to the plug-jack mating points of plug blades 141-148. Various features of plug 116 that may facilitate reducing the amount of offending crosstalk that is injected farther back in the plug 116 will now be described.

First, the conductors 101-108 terminate onto both the top and bottom sides of the printed circuit board 150. This allows the conductors 101-108 of different differential pairs to be spaced apart a greater distance along the transverse dimension, which reduces crosstalk between the pairs. Likewise, the conductive paths 161-168 are arranged in pairs that are generally spaced far apart from each other in order to reduce or minimize coupling between the differential transmission lines 171-174 until those transmission lines reach the front section of the printed circuit board 150 underneath the plug blades 141-148.

Additionally, a pair of reflection or "image" planes 130, 130' are included in the printed circuit board 150. The first image plane 130 is located just below a top surface of the printed circuit board 150, and the second image plane 130' is located just above a bottom surface of the printed circuit board 150. Each image plane 130, 130' may be implemented as a conductive layer on the printed circuit board 150. In some embodiments, the image planes 130, 130' may be grounded or may be electrically floating. The image planes 130, 130' may act as shielding structures that reduce coupling between the conductive structures on the printed circuit board 150.

Additionally, the back end of plug 116 includes a "crosstail" 190 that spaces the conductor pairs 101, 102; 103, 106; 104, 105; 107, 108 apart from each other in order to reduce coupling between them. Herein, the term "crosstail" refers to a structure that separates each of the four conductor pairs of a cable from the other pairs. Typically, a crosstail separator has four fins that are radially spaced apart by about 90 degrees and that protrude from a center section of the separator. As a result, "crosstail" often has a generally cruciform cross-section. The crosstail 190 (or portions thereof) may be plated with a conductive material or formed of a conductive material in order to enhance its shielding properties.

As shown best in FIG. 4, the crosstail 190 has four fins 191-194 that radiate from a central core 195. The four fins 191-194 are radially spaced apart by about 90 degrees. These fins 191-194 define four channels, and one pair of conductors is received within each channel. The first and second fins 191, 192 each extend farther forwardly than the third and fourth fins 193, 194. Thus, the forward portions of the first fin 191, the second fin 192 and the central core 195 create a vertically-oriented wall 196 that extends from the remainder of the crosstail 190. A notch 159 is provided in the center of the rear section of the printed circuit board 150. The vertically-oriented wall 196 may be received within this notch 159. As a result, the first fin 191 extends upwardly above the top of a rear portion of the printed circuit board 150 to act as a first conductive shield, and the second fin 192 extends downwardly below the bottom of the rear portion of the printed circuit board 150 to act as a second conductive shield. Thus, the first fin 191 is interposed between the end portions of the conductors of twisted pair 111 and twisted pair 112, and the second fin 192 is interposed between the end portions of the conductors of twisted pair 113 and twisted pair 114. In each case these fins 191, 192 will act as shields that reduce coupling between the conductors of the adjacent twisted pairs 111, 112 and 113, 114.

While in the depicted embodiment the printed circuit board includes the notch 159 to allow the vertically-oriented wall 196 to extend forwardly past the rear edge of printed circuit board 150, it will be appreciated that other designs may be used. For example, in an alternative embodiment, the forward portion of the central core 195 may be omitted (as well as part of the base of the forward portions of fins 191, 192, as necessary, depending upon the thickness of the printed circuit board 150). In this embodiment, the forward portion of fin 191 will be positioned above the top surface of the printed circuit board 150, and the forward portion of fin 192 will be positioned below the bottom surface of printed circuit board 150. This embodiment eliminates any need for the notch 159 in printed circuit board 150 while still providing a first conductive shield that is interposed between the conductors of twisted pairs 111 and 112 at the rear of printed circuit board 150, and a second conductive shield that is interposed between the conductors of twisted pairs 113 and 114 at the rear of printed circuit board 150. In still other embodiments, the first and/or the second conductive shields may be implemented using structures separate from the crosstail. For example, the notch 159 in printed circuit board may be omitted and replaced with metal pads on the top and bottom surfaces of the printed circuit board 150. First and second vertically oriented conductive walls may be soldered onto these metal pads which would act as conductive shields in place of the fins 191 and 192 shown in FIG. 4.

The third fin 193 and the fourth fin 194 may each have a widened section 193', 194' that is located adjacent the printed circuit board 150 when the plug 116 is fully assembled. In the back part of the crosstail 190, each twisted pair will be tightly twisted. As shown in FIG. 4, as the twisted pairs 111-114 approach the printed circuit board 150 the conductors of each pair are arranged in a side-by-side fashion. This facilitates terminating each conductor onto its respective conductive pad 151-158 on the printed circuit board 150. The widened sections 193', 194' of the third and fourth fins 193, 194 may provide support for each conductor 101-108 immediately adjacent its soldered or welded connection to its respective conductive pad 151-158.

The above described conductive shields (e.g., the forward portions of fins 191, 192 or other similar shielding structures) may also facilitate controlling the impedance of the differential transmission lines through the plug 116. As the conductors 101-108 transition from their twisted state within the cable 110 to their untwisted state at their interface with the rear of the printed circuit board 150, the impedance of each twisted pair 111-114 will typically increase. Any shielding that is provided in the cable (e.g., individual shields around each twisted pair 111-114 or a single shield that surrounds all four pairs on the inside of cable jacket 109) will also typically be cut away, and the absence of these shielding structures will also typically act to increase the impedance of each twisted pair 111-114. The same is true with respect to the insulative cores **101*b*-108*b* that are stripped from the very end portions of each conductive core 101*a*-108*a* of the conductors 101-108. The metalized crosstail 190 or other conductive shields that extend above and/or below the printed circuit board 150 may counteract these effects, and help to reduce or prevent these increases in the impedance of the twisted pairs 111-114**.

Figure 11A:
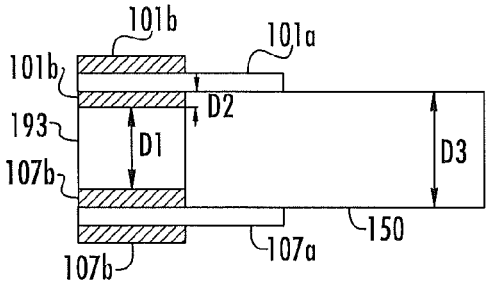
FIGS. 11A and 11B are schematic side cross-sectional views of printed circuit boards and conductors of plugs according to embodiments of the present invention that illustrate how the thickness of the printed circuit board may be matched to the pitch of the cable.

In some embodiments, the thickness of the printed circuit board 150 may be generally matched to "pitch" of the conductors 101-108 at the end of the cable 100. The "pitch" of the conductors refers to the vertical distance between (a) the top of the conductive core of a first of the conductors 101-108 that is terminated into the bottom side of the printed circuit board 150 and (b) the bottom of the conductive core of a second of the conductors 101-108 that is terminated into the top side of the printed circuit board 150 directly above the first conductor. This is illustrated graphically in FIG. 11A. As shown in FIG. 11A, the third fin 193 (as well as the fourth fin 194, which is visible in FIG. 4) may have a first thickness D1. Each conductor 101-108 has a conductive core 101*a*-108*a* that is surrounded by an insulative cover 101*b*-108*b*. The end portion of the insulative cover 101*b*-108*b* of each conductor 101-108 may be stripped away, as shown in FIGS. 4 and 11A. Typically, the insulative cover 101*b*-108*b* is kept on each conductor right up to the point where the conductors 101-108 meet the rear edge of the printed circuit board 150 to reduce the possibility that two of the conductors 101-108 become short-circuited. The insulative cover, which is annular in nature, may have a thickness of D2. As can be seen in FIG. 11A, the printed circuit board 150 has a thickness D3. In some embodiments, D3 may approximately equal (D1+2*D2). When this condition is met, the stripped conductive cores 101*a*-108*a* that extend from each conductor 101-108 will naturally be positioned so that they are just above or below their respective conductive pads 151-158. This may make it easier to solder or weld each conductive core 101*a*-108*a* to its respective conductive pad 151-158, and may reduce or avoid kinks or bends in the conductive cores 101*a*-108*a* that may negatively impact the strength of each solder/weld. While values may vary considerably, in some embodiments the fins 193, 194 may have a thickness of about 20 mils to about 60 mils, and the insulative cover 101*b*-108*b* on each conductor 101-108 may have a thickness between about 5 and 20 mils. Thus, for a fin thickness of 40 mils and an insulative cover thickness of 10 mils, the printed circuit board 150 would have a thickness of about 60 mils (e.g., 54-66 mils).

Figure 11B:
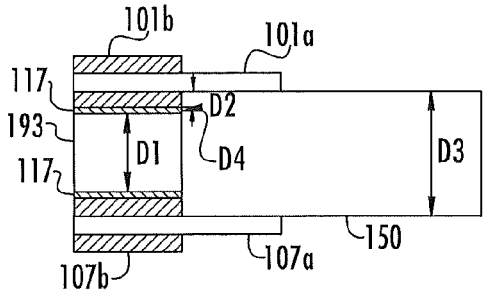

As is shown in FIG. 11B, in some embodiments, a shield 117 may surround each twisted pair 111-114. Typically shielded twisted pairs are individually shielded using a thin conductive foil such as an aluminzed mylar foil that may have a thickness of perhaps 1-2 mils. In embodiments that include shields on each twisted pair, the thickness D3 of the printed circuit board 150 may be set to be substantially equal to (D1+2*D2+2*D4), where D4 is the thickness of the shield 117 used on the individual twisted pairs.

Figure 12:
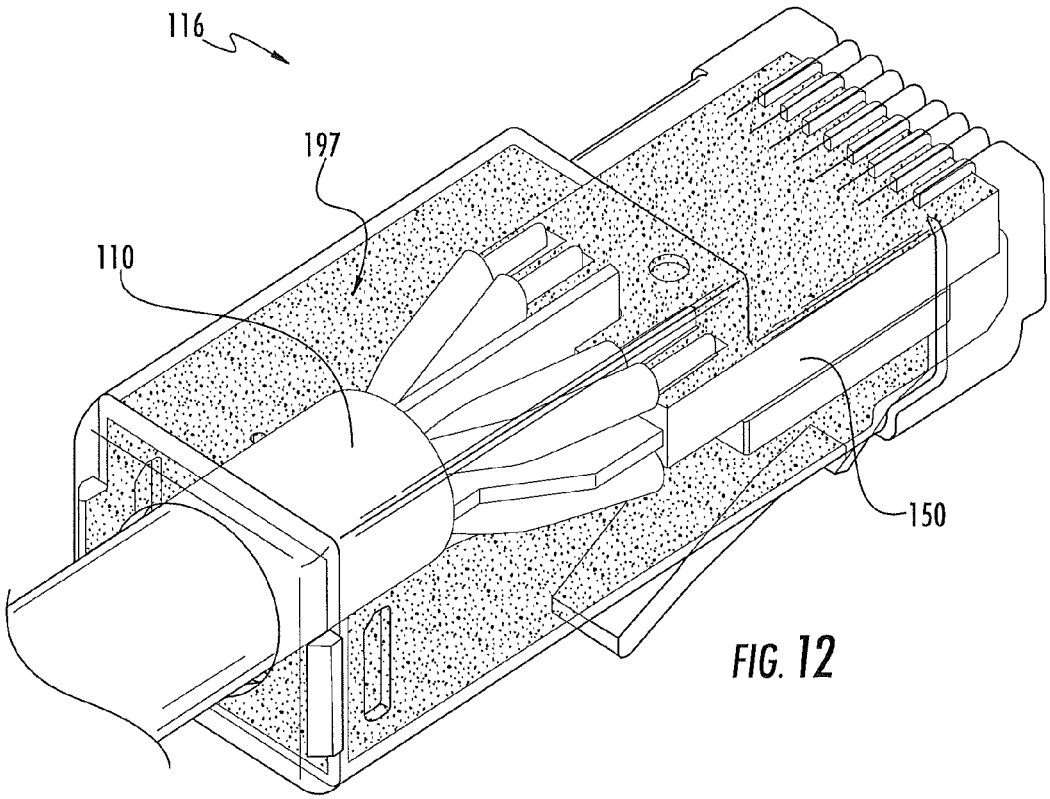
FIG. 12 is a perspective view of a communications plug according to further embodiments of the present invention that includes a lossy dielectric filler within the plug housing.

Additionally, referring now to FIG. 12, in some embodiments, a lossy dielectric material 197 may be injected into the plug housing 120 after the printed circuit board 150, the crosstail 190 and conductors 101-108 are installed within the housing. As known to those of skill in the art, a lossy dielectric refers to a dielectric material that has a high degree of attenuation or ability to dissipate energy by converting the energy to heat. As such, the lossy dielectric material 197 may act to attenuate the electrical fields emanating from the various conductive structures (e.g., the conductive cores 101*a*-108*a*, the plug blades 141-148, the conductive pads 151-158, the conductive paths 161-168, and the conductive vias 131-138 and 133-1, 134-1, 135-1, 135-2, 136-1) that are included in the plug 116. This may reduce differential-to-differential and differential-to-common mode crosstalk within the plug 116, and alien crosstalk from the plug 116 to other connectors in a communications system (e.g., an adjacent plug or jack).

The lossy dielectric material 197 may be, for example, a liquid or foam (e.g., a carbon-loaded foam) that is injected into the plug housing 120 after the plug is assembled. This liquid or foam 197 may fill in much of the empty space within the plug housing 120. The liquid or foam lossy dielectric material 197 may be designed to harden either simply by exposure to air or through a curing process such as, for example, exposure to heat, ultraviolet light, etc. As such, the liquid or foam lossy dielectric material 197 may be injected through any one or more appropriate openings into the interior of the housing (e.g., the back opening 128 and/or other openings (not shown in the figures) that are provided in the housing 120. It may not be necessary to seal these one or more openings after injection of the lossy dielectric material 197 due to the fact that the material 197 hardens into a solid after injection.

In addition to reducing electric field emissions from conductive structures within the plug housing 120, the lossy dielectric material 197 may also help to mechanically secure the various structures into their proper positions within plug 116, thereby providing a more robust plug design. This may be important as any movement of the conductive and/or various of the dielectric structures within plug 116 may significantly impact the electrical performance of the plug 116, as the plug may be designed to generate highly controlled amounts of crosstalk in order to allow for precise cancellation of such offending crosstalk in a mating jack. In some embodiments, the lossy dielectric material 197 may be in the form of a lossy epoxy or other material that has adhesive properties that may not only fill the empty space in the housing 120 but also secure everything within the housing 120 together and to the inside surfaces of the housing 120.

Pursuant to still further embodiments of the present invention, communications plugs such as RJ-45 plugs are provided which include a printed circuit board that is mounted at an oblique angle within the plug housing.

Figure 13:
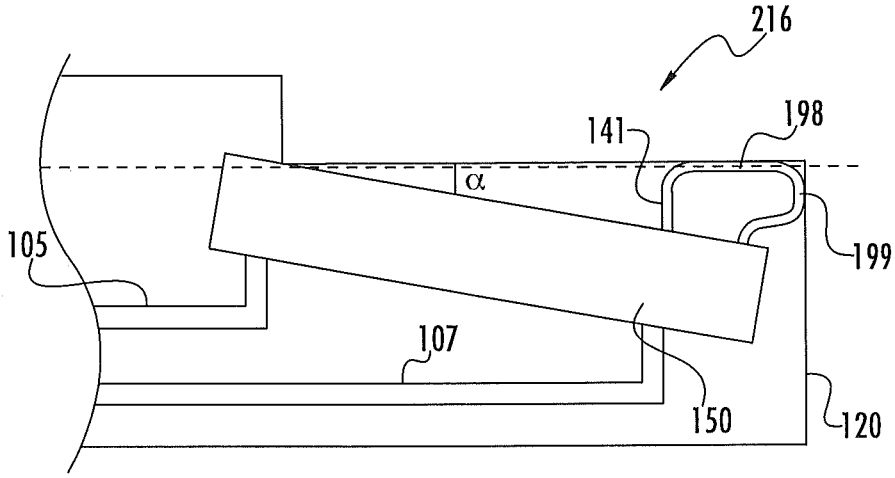
FIGS. 13 and 14 are schematic side views of communications plugs according to additional embodiments of the present invention that include angled printed circuit boards that facilitate terminating the conductors of the communications cable into the printed circuit board.

For example, FIG. 13 is a side view of a plug 216 according to embodiments of the present invention that schematically illustrates such an implementation. As shown in FIG. 13, in the plug 216 the printed circuit board 150 is disposed at an oblique angle within the plug housing 120. Interior surfaces of the housing (not shown) or other structures may be used to hold the printed circuit board at the oblique angle within the plug housing 120.

As shown in FIG. 13, by disposing the printed circuit board 150 at an oblique angle with respect to, for example, a bottom surface of the housing 120, more room may be provided between the bottom surface of the printed circuit board 150 and the bottom surface of the housing 120. This may facilitate terminating all eight conductors 101-108 of the cable 110 (only two of the conductors are depicted in FIG. 13 to simplify the drawing) into the bottom surface of the printed circuit board 150. In some embodiments, four of the conductors (two pairs) may be terminated into the front half of the printed circuit board 150 (such as conductor 107) and the other four (the other two pairs) may be terminated into the back half of the printed circuit board 150 (such as conductor 105). The conductors 101-108 may be maintained as twisted pairs right up to their point of termination into the printed circuit board 150. In the embodiment of FIG. 13, the bottom surface of the printed circuit board 150 and a bottom surface of the housing 120 may define an acute angle.

In the embodiment of FIG. 13, the plug blades 141-148 are implemented as skeletal plug blades. The skeletal plug blades 141-148 may be implemented, for example, using wires that have both ends terminated into the top surface of printed circuit board 150 (alternatively, the front end of some or all of the skeletal plug blades 141-148 may be terminated into the front surface of printed circuit board 150). Skeletal plug blades 141-148 may be used to reduce capacitive coupling between adjacent plug blades, as the angled mounting of the printed circuit board 150 may otherwise increase the size of the plug blades 141-148. Each plug blade 141-148 may have a top surface 198 and a front surface 199 that are connected by a curved transition region. The top surfaces 198 of the eight plug blades 141-148 may be aligned in a row and may define a plane. The top surface of the printed circuit board 150 may intersect the plane defined by the top surfaces 198 of the eight plug blades 141-148 at an angle α. The angle α may be an oblique angle. In some embodiments, the angle α may be between about 10 degrees and about 30 degrees.

Figure 14:
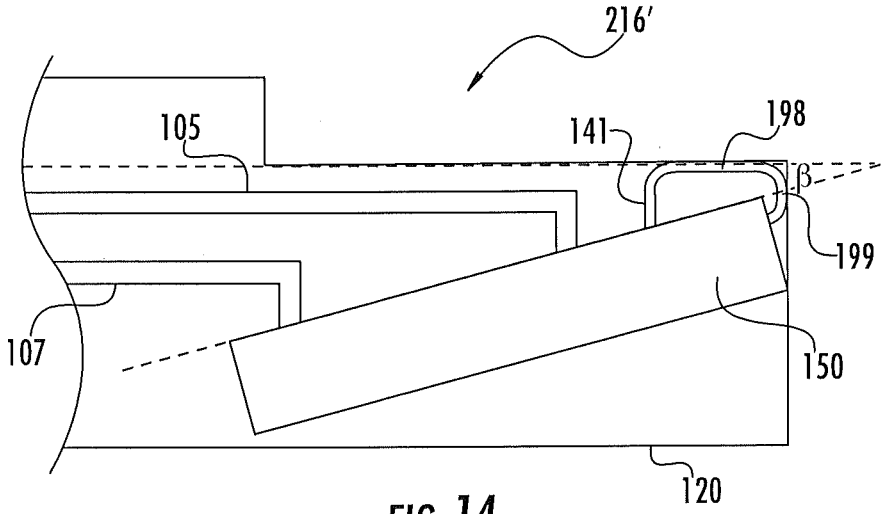

FIG. 14 is a schematic side view of a plug 216' that illustrates another implementation of a plug having a printed circuit board 150 mounted at an angle therein. As shown in FIG. 13, the plug 216' is similar to the plug 216 described above, except that the printed circuit board 150 in the plug 216' is angled in the opposite direction (i.e., the front surface of the printed circuit board 150 in plug 216' is angled toward the top of the housing 120 as opposed toward the bottom of the housing 120 in the case of plug 216).

As shown in FIG. 14, angling the printed circuit board 150 so that the front surface thereof is angled towards the top of the plug housing 120 may facilitate terminating all eight conductors into the top surface of the printed circuit board 150 (only two of the conductors are depicted in FIG. 14 to simplify the drawing). Four of the conductors (two pairs) may be terminated into the front half of the printed circuit board 150 (such as conductor 105) and the other four (the other two pairs) may be terminated into the back half of the printed circuit board 150 (such as conductor 107). The conductors 101-108 may be maintained as twisted pairs right up to their point of termination into the printed circuit board 150.

In the embodiment of FIG. 14, the plug blades 141-148 may again be implemented as skeletal plug blades. Each plug blade 141-148 may have a top surface 198 and a front surface 199 that are connected by a curved transition region. The top surfaces 198 of the eight plug blades 141-148 may be aligned in a row and may define a plane. The top surface of the printed circuit board 150 may intersect the plane defined by the top surfaces 198 of the eight plug blades 141-148 at an angle β. The angle β may be an oblique angle. In some embodiments, the angle β may be between about 10 degrees and about 30 degrees.

The communications plugs according to embodiments of the present invention may also include features that may improve the return loss on the differential transmission lines through the plugs. This improved return loss may be achieved, for example, by generating inductive and/or capacitive self-coupling along the differential transmission lines. This self-coupling may help counteract the loads placed on the differential transmission lines by the high levels of crosstalk compensation that may be necessary to counteract the offending crosstalk (particularly for high frequency signals), and hence may provide improved return loss on the transmission lines.

Figure 15:
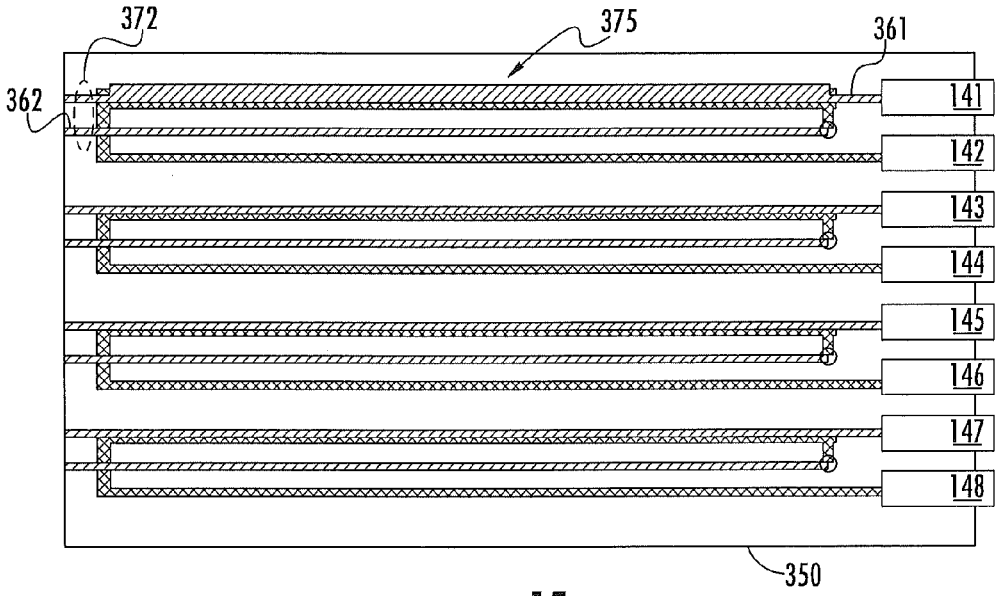
FIG. 15 is a schematic plan view of a flexible printed circuit board that may be used in communications plugs according to still further embodiments of the present invention.

FIG. 15 is a schematic plan view of a printed circuit board 350 for a communications plug according to further embodiments of the present invention. The printed circuit board 350 may be a flexible printed circuit board that includes one or more dielectric layers that have conductive traces disposed on one or both sides thereof (the traces on the bottom are shown using cross-hatching). The dielectric layers of the flexible printed circuit board 350 may be much thinner than the dielectric layers of conventional printed circuit boards; for example, in some embodiments, the dielectric layers of the flexible printed circuit board 350 may have a thickness of 1 mil or less. The flexible printed circuit board 350 may be used, for example, in place of the printed circuit board 150 that is included in the communications plug 116 discussed above. The flexible printed circuit board 350 may take up less room within the plug housing 120 and may include features that may provide for enhanced crosstalk and/or return loss performance.

For example, in U.S. Pat. No. 7,264,516, issued Sep. 4, 2007, the entire contents of which are incorporated herein by reference, teaches arranging printed circuit board coupling sections of the two conductive paths of a differential transmission line of a communications connector such that they are immediately adjacent each other and such that they follow substantially parallel paths having the same instantaneous current directions. By judicious selection of the portions of the two conductive paths that are immediately adjacent each other with substantially identical instantaneous current directions it may be possible to control the input impedance of a differential transmission line through a mated plug-jack combination, and, consequently, it may be possible to control the return loss of the differential transmission line. As a result, the jack of the mated plug-jack combination can withstand the increased crosstalk compensation that may be necessary to achieve, in a mated plug-jack combination, elevated frequency signal transmission while still experiencing acceptable levels of return loss.

Pursuant to embodiments of the present invention, communications plugs are provided that implement the teachings of the above-referenced U.S. Pat. No. 7,264,516. For example, as shown in FIG. 15, the flexible printed circuit board 350 includes a return loss improvement circuit 375 along a differential transmission line 372 that includes conductive paths 361 and 362. This return loss improvement circuit 375 is formed by routing conductive path 361 on the top side of the flexible printed circuit board 350 and by routing a section of conductive path 362 on the opposite side of the flexible printed circuit board 350 underneath conductive path 361. The section of the conductive path 362 that runs underneath conductive path 361 is routed so that the signals flowing on traces 361, 362 will have the same instantaneous current direction in the return loss improvement circuit 375 (this may be done by routing the section of conductive path 362 so that it travels in the opposite direction from the section of conductive path 361). This will trigger an increase in localized inductance along these trace sections that may improve the return loss for the differential transmission line 372. As the flexible printed circuit board 350 may be quite thin, a high amount of inductive coupling may be achieved in the return loss improvement circuit 375, which may provide for a significant improvement in return loss on differential transmission line 372.

Moreover, since the coupling portions of conductive paths 361, 362 are implemented on opposite sides of the flexible printed circuit board 350, these portions of conductive paths 361, 362 will not only inductively couple, but may also experience significant capacitive coupling, given the thin nature of the dielectric layer of the flexible printed circuit board 350. This is particularly true if the coupling portions of conductive paths 361, 362 are widened as shown in FIG. 15. This capacitive coupling may further improve the return loss on the differential transmission line 372. As shown in FIG. 15, such return loss improvement circuits may be provided on each of the differential transmission lines, and each return loss improvement circuit may or may not have widened trace segments.

By generating both inductive coupling and capacitive coupling along the differential transmission line 372 it may be possible to provide a significant improvement in the return loss of the differential transmission line. It may be difficult, in some instances, to provide return loss improvement across an extended frequency range by generating only or mostly inductive coupling. In some embodiments, the amount of capacitive coupling generated between conductive paths 361, 362 may be at least half the amount of the inductive coupling.

Figure 16:
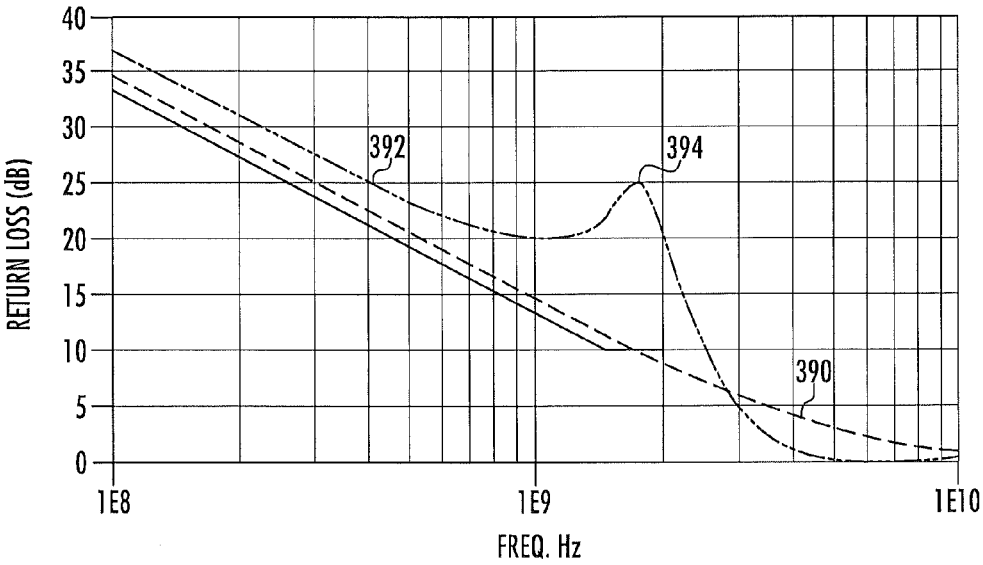
FIG. 16 is a schematic graph that illustrates how the relative amounts of inductive and capacitive coupling between the conductive paths of a differential transmission line may be tuned to generate a local maximum in the return loss spectrum for the differential transmission line.

Moreover, pursuant to some embodiments of the present invention, the ratio of the amount of capacitive coupling between the two conductive paths of a differential transmission line to the amount of inductive coupling between the two conductive paths of the differential transmission line may be tuned to improve the return loss of the differential transmission line. In particular, it has been discovered that by generating both inductive coupling and capacitive coupling along a differential transmission line that resonances may be created. By adjusting the relative amount of capacitive coupling to the amount of inductive coupling these resonances may be tuned so as to create a local maximum in the return loss spectrum for the differential transmission line. For example, FIG. 16 schematically illustrates how the above-described coupling between the conductive paths of a differential transmission line may generate a local maximum in the return loss spectrum (i.e., the return loss plotted as a function of frequency) for the differential transmission line. In particular, FIG. 16 schematically depicts the return loss of an example differential transmission line as a function of frequency where no special measures are taken to improve the return loss (plot 390). As plot 390 in FIG. 16 illustrates, return loss typically degrades with increasing frequency, and at some point the return loss may reach unacceptable levels. As shown by plot 392 in FIG. 16, by generating inductive and capacitive between the conductive paths of the differential transmission line it may be possible to improve the return loss of the differential transmission line over some range of frequencies (e.g., plot 392 exhibits improved return loss as compared to plot 390 in FIG. 16 for all frequencies below about 2.9 GHz). Moreover, by tuning (adjusting) the relative amounts of inductive and capacitive coupling generated between the conductive paths of the differential transmission line, the location (in frequency) of the local maximum 394 that may be provided in the return loss spectrum of plot 392 may be adjusted. In some embodiments, the inductive and capacitive coupling may be tuned so that the local maximum 394 is located near a maximum operating frequency for the connector at issue (e.g., between 60% and 125% of the maximum operating frequency). This may provide for a significant improvement in the return loss of the differential transmission line at issue in the region where improved performance may be most needed. The ratio of the amount of capacitive coupling to the amount of inductive coupling can be adjusted, for example, by adjusting the widths of the coupling traces (as increased width generates relatively more capacitive coupling than inductive coupling) and/or by adjusting the amount of overlap of the traces on the opposite sides of the printed circuit board 350 (as increased overlap generates relatively more capacitive coupling than inductive coupling).

Figure 17:
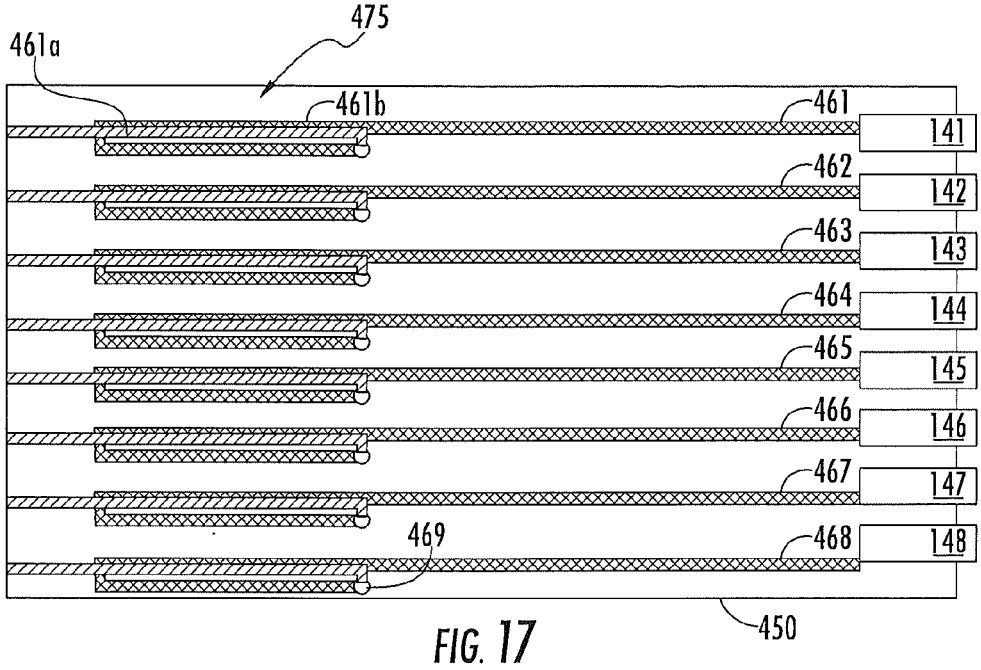
FIG. 17 is a schematic plan view of a flexible printed circuit board that may be used in communications plugs according to yet further embodiments of the present invention.

While FIG. 15 illustrates one type of return loss improvement circuit, it will be appreciated that other circuit implementations may be used. For example, as is discussed in U.S. Pat. No. 7,326,089, issued Feb. 5, 2008, the entire content of which is incorporated herein by reference as if set forth in its entirety, providing self-coupling sections along just one conductive path of a differential transmission line may also be used to generate a localized increase in self-inductance that may improve the return loss of the differential transmission line. FIG. 17 is a schematic plan view of a flexible printed circuit board 450 for a communications plug that illustrates such a technique. The flexible printed circuit board 450 may be used, for example, in place of the printed circuit board 150 that is included in the communications plug 116 discussed above. The flexible printed circuit board 450 includes eight conductive paths that connect the conductors 101-108 of cable 110 (not shown) to the respective jackwire contacts 141-148. In FIG. 17, the hatched traces are traces on the top side of the flexible printed circuit board 450 and the cross-hatched traces are traces on the bottom side of the flexible printed circuit board 450. A conductive via 469 is provided on each of the conductive paths 461-468 that electrically connects the portion of the conductive path that is on the top side of the flexible printed circuit board 450 to the portion that is on the bottom side of the flexible printed circuit board 450.

As shown in FIG. 17, a return loss improvement circuit 475 is provided along conductive path 461. The return loss improvement circuit 475 is implemented as a pair of self-coupling sections 461*a*, 461*b* that are included in the conductive path 461. As shown in FIG. 17, the return loss improvement circuit 475 is implemented by transferring the conductive path 461 from the top side of the flexible printed circuit board 450 to the bottom side using conductive via 469, then routing conductive path back in the opposite direction (i.e., away from the plug blades), and then passing conductive trace 461 back through another 180 degree turn so that conductive trace section 461*b* is located underneath conductive section trace 461*a*. This configuration provides the return loss improvement circuit 475 as conductive trace sections 461*a* and 461*b* will have the same instantaneous current direction and will heavily couple with each other as they run on top of each other separated only by the thin dielectric layer of the flexible printed circuit board 450. The immediate adjacency of trace sections 461*a*, 461*b* having substantially the same instantaneous current direction results in self-coupling between the adjacent sections 461*a*, 461*b* of conductive path 461, which in turn triggers an increase in localized inductance.

In addition, the arrangement of the trace sections 461*a*, 461*b* that are depicted in FIG. 17 may also generate substantial amounts of self-capacitance on conductive path 461. The amount of capacitive coupling may be judiciously selected to improve or optimize the return loss on the differential transmission line that includes conductive trace 461. For example, heightened levels of capacitive self-coupling may be achieved by widening the conductive traces 461*a*, 461*b*. Alternatively, the level of capacitive self-coupling may be lowered by offsetting the trace sections 461*a* and 461*b* relative to each other such that they partially overlap. As shown in FIG. 17, similar return loss improvement circuits may be provided on each of the conductive paths 461-468 (or along any subset of the conductive paths 461-468).

It will be appreciated that the techniques for adjusting the relative amounts of capacitive and inductive coupling that are discussed above with respect to FIGS. 15-16 may also be applied in the embodiment of FIG. 17 to generate a local maximum in the return loss spectrum and to locate that null in a location that provides desired return loss performance for the differential transmission line.

Pursuant to still further embodiments of the present invention, crosstalk compensation circuits are provided that are implemented on flexible printed circuit boards in order to achieve high amounts of crosstalk compensation with very short coupling sections. As discussed above, the dielectric layers on flexible printed circuit boards may be very thin (e.g., 1 mil). This allows for significant amounts of coupling between overlapping traces that are implemented on either side if the flexible printed circuit board. As inductive crosstalk compensation requires current flow, it necessarily is spread out in time. When crosstalk compensation is spread over time, it necessarily involves an associated delay. With all things being equal, improved crosstalk compensation may generally be provided with a shorter delay, as the ability to introduce large amounts of inductive crosstalk compensation within very short trace segments may be desirable. Communications plugs that implement this technique are provided pursuant to further embodiments of the present invention.

Figure 18:
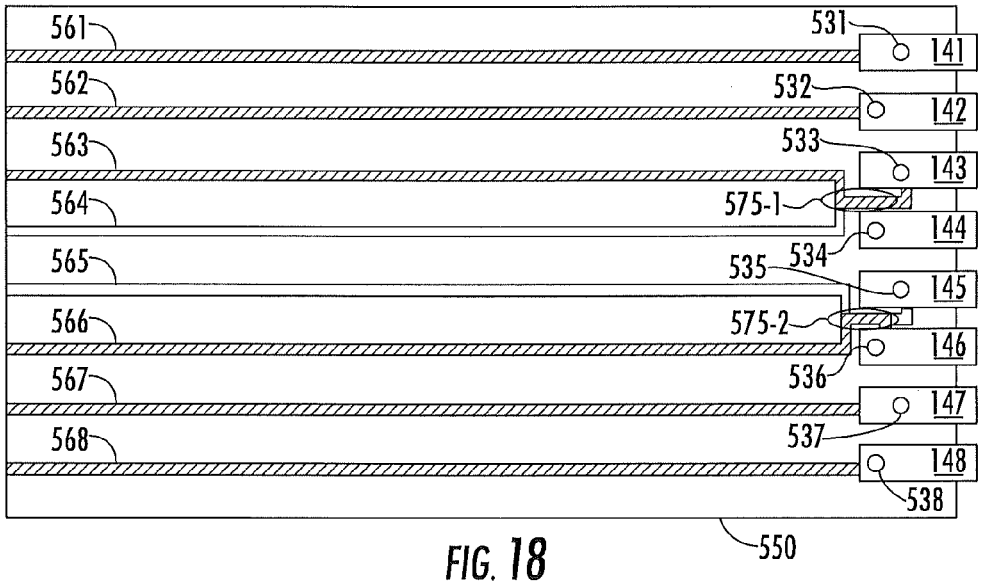
FIG. 18 is a schematic plan view of a flexible printed circuit board of a communications plug according to still further embodiments of the present invention.

In particular, FIG. 18 is a schematic plan view of a flexible printed circuit board 550 of a communications plug according to further embodiments of the present invention. The flexible printed circuit board 550 may be used in place of the flexible printed circuit board 150 discussed above. It will be appreciated that various features of flexible printed circuit board 550 are illustrated schematically, as the focus of FIG. 18 is to illustrate how offending inductive crosstalk circuits may be implemented on the flexible printed circuit board 550 very close to the plug-jack mating point.

In particular, as shown in FIG. 18, the flexible printed circuit board 550 includes eight conductive paths 561-568 that connect the conductors 101-108 of cable 110 (not shown) to eight conductive vias 531-538 that receive the respective plug blades 141-148. In FIG. 18, the hatched traces are traces on the top side of the flexible printed circuit board 550 and the clear traces are traces on the bottom side of the flexible printed circuit board 550.

As is further shown in FIG. 18, in order to generate offending inductive crosstalk, a pair of offending inductive crosstalk circuits 575-1 and 575-2 are provided on flexible printed circuit board 550. Offending inductive crosstalk circuits 575-1 is formed by routing a small segment of conductive path 564 on the bottom side of flexible printed circuit board 550 so that it is directly under (or at least partially overlapped by) a corresponding small section of conductive path 563 (which is on the top side of flexible printed circuit board 550). As the top and bottom sides of flexible printed circuit board 550 are separated by a very thin dielectric layer (e.g., a dielectric layer that is 1-2 mils thick), a large amount of inductive coupling is generated between conductive paths 563 and 564 with a very short inductive coupling section 575-1. In practice, it is believed that the same level of inductive coupling can be achieved in a much shorter signal travel distance using the design of FIG. 18 as compared to the design of FIGS. 7-10 which primarily uses inductively coupling conductive vias to generate the offending inductive crosstalk. As higher levels of inductive coupling may be achieved using the offending inductive crosstalk circuits 575-1, 575-2, the centroid of the inductive coupling sections may be moved closer to the plug jack mating point. As such, it may be easier to compensate for this offending crosstalk in a mating jack.

As shown in FIG. 18, in some embodiments, a portion of the offending inductive crosstalk circuit 575-1 is positioned between plug contact 143 and plug contact 144, thereby locating offending inductive crosstalk circuit 575-1 very close to the plug-jack mating point. Likewise, a portion of the offending inductive crosstalk circuit 575-2 is positioned between plug contact 145 and plug contact 146, thereby locating offending inductive crosstalk circuit 575-2 very close to the plug-jack mating point. In some embodiments, the inductively coupling trace sections that are used to form the offending inductive crosstalk circuits 575-1, 575-2 may completely overlap. In other embodiments, the inductively coupling trace sections that are used to form the offending inductive crosstalk circuits 575-1, 575-2 may only partially overlap. Partially overlapping the coupling sections may help minimize the capacitive coupling that is also generated across the flexible circuit board in the design of FIG. 18. Doing so may be desirable in order to contain the capacitive component of the offending crosstalk as close to the plug blades as possible. Moreover, the amount of offending inductive crosstalk generated in each circuit 575-1, 575-2 may be adjusted by altering the lengths of the overlapping sections and/or the degree of overlap.

The present invention is not limited to the illustrated embodiments discussed above; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "top," "bottom," "side," "upper," "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the term "signal current carrying path" is used to refer to a current carrying path on which an information signal will travel on its way from the input to the output of a communications plug. Signal current carrying paths may be formed by cascading one or more conductive traces on a wiring board, metal-filled apertures that physically and electrically connect conductive traces on different layers of a printed circuit board, portions of plug blades, conductive pads, and/or various other electrically conductive components over which an information signal may be transmitted. Branches that extend from a signal current carrying path and then dead end such as, for example, a branch from the signal current carrying path that forms one of the electrodes of an inter-digitated finger or plate capacitor, are not considered part of the signal current carrying path, even though these branches are electrically connected to the signal current carrying path. While a small amount of current will flow into such dead end branches, the current that flows into these dead end branches generally does not flow to the output of the plug that corresponds to the input of the plug that receives the input information signal.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, integers, steps, operations, elements, and/or components, but do not preclude the presence or addition of one or more other features, integers, steps, operations, elements, components, and/or groups thereof.

All of the above-described embodiments may be combined in any way to provide a plurality of additional embodiments.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications plug, comprising:

a first conductive path electrically connecting a first input of the plug and a first output of the plug;

a second conductive path electrically connecting a second input of the plug and a second output of the plug, wherein the first and second conductive paths comprise a first differential pair of conductive paths for transmitting a first information signal;

a third conductive path electrically connecting a third input of the plug and a third output of the plug; and a fourth conductive path electrically connecting a fourth input of the plug and a fourth output of the plug, wherein the third and fourth conductive paths comprise a second differential pair of conductive paths for transmitting a second information signal, wherein a first section of the first conductive path and a second section of the second conductive path are configured to have generally the same instantaneous current direction and are positioned to both capacitively and inductively couple with each other.

2. The communications plug of claim 1, wherein the amount of capacitive coupling is at least half the amount of the inductive coupling.

3. The communications plug of claim 1, further comprising a flexible printed circuit board, wherein the first section of the first conductive path is on a first side of the flexible printed circuit board and the second section of the second conductive path is on a second side of the flexible printed circuit board that is opposite the first side.

4. The communications plug of claim 1, wherein the ratio of the capacitive coupling between first section of the first conductive path and the second section of the second conductive path to the inductive coupling between first section of the first conductive path and the second section of the second conductive path is selected to provide a local maximum in a return loss spectrum for the first differential pair of conductive paths.

5. The communications plug of claim 3, wherein a third section of the third conductive path and a fourth section of the fourth conductive path are configured to have generally the same instantaneous current direction and are positioned to both capacitively and inductively couple with each other.

6. The communications plug of claim 3, wherein the first section of the first conductive path is wider than at least some other portions of the first conductive path on the flexible printed circuit board.

7. The communications plug of claim 1, wherein the local maximum in the return loss spectrum for the first differential pair of conductive paths is located at a frequency that is between 60% and 125% of a maximum operating frequency for the communications plug.

8. A communications plug, comprising:

a housing having a plug aperture;

a flexible printed circuit board that is at least partly mounted within the housing;

a first conductive path electrically connecting a first input of the plug and a first output of the plug;

a second conductive path electrically connecting a second input of the plug and a second output of the plug, wherein the first and second conductive paths comprise a first differential pair of conductive paths;

wherein the first conductive path includes first and second conductive trace sections on the flexible printed circuit board that are immediately adjacent to each other and that have generally the same instantaneous current direction such that the first and second conductive trace sections self-couple and cause a localized increase in inductance, and wherein the first conductive trace section is on a first side of the flexible printed circuit board and the second conductive trace section is on a second side of the flexible printed circuit board that is opposite the first side, and wherein the first and second conductive trace sections are configured to both inductively and capacitively couple with each other.

9. The communications plug of claim 8, wherein the first conductive trace section comprises a spiral.

10. The communications plug of claim 9, wherein the spiral at least partially overlaps the second conductive trace section.

11. The communications plug of claim 8, wherein an amount of capacitive coupling between the first conductive trace section and the second conductive trace section is at least half an amount of inductive coupling between the first conductive trace section and the second conductive trace section.

12. The communications plug of claim 8, wherein the ratio of the capacitive coupling between the first conductive trace section and the second conductive trace section is selected to provide a local maximum in a return loss spectrum for the first differential pair of conductive paths.

13. The communications plug of claim 8, wherein the first conductive trace section and the second conductive trace section are wider than at least some other portions of the first conductive path on the flexible printed circuit board.

14. A communications plug, comprising:

a housing;

a flexible printed circuit board mounted in the housing, the flexible printed circuit board having a first conductive path and a second conductive path that form a first differential pair of conductive paths and a third conductive path and a fourth conductive path that form a second differential pair of conductive paths;

a first plug contact that is electrically connected to the first conductive path;

a second plug contact that is electrically connected to the second conductive path, the second plug contact being immediately adjacent to the first plug contact;

a third plug contact that is electrically connected to the third conductive path;

a fourth plug contact that is electrically connected to the fourth conductive path;

wherein a section of the first conductive path is on a first side of the flexible printed circuit board and a section of the second conductive path is on a second side of the flexible printed circuit board that is opposite the first side, and wherein the section of the first conductive path and the section of the third conductive path are configured to inductively couple to provide a first offending inductive crosstalk circuit.

15. The communications plug of claim 14, wherein the section of the first conductive path and the section of the third conductive path partially overlap but do not completely overlap.

16. The communications plug of claim 15, wherein the second plug contact is immediately adjacent to the fourth plug contact, wherein a section of the second conductive path is on the first side of the flexible printed circuit board and a section of the fourth conductive path is on a the second side of the flexible printed circuit board, and wherein the section of the second conductive path and the section of the fourth conductive path are configured to inductively couple to provide a second offending inductive crosstalk circuit.

17. The communications plug of claim 16, where the first offending inductive crosstalk circuit is at least partly positioned between the first plug contact and the third plug contact, and wherein the second offending inductive crosstalk circuit is at least partly positioned between the second plug contact and the fourth plug contact.

* * * * *

UNITED STATES PATENT AND TRADEMARK OFFICE

CERTIFICATE OF CORRECTION

PATENT NO. : 8,894,447 B2
APPLICATION NO. : 13/802856
DATED : November 25, 2014
INVENTOR(S) : Canning et al.

It is certified that error appears in the above-identified patent and that said Letters Patent is hereby corrected as shown below:

In the Claims:

Column 25, Claim 16, Line 5: Please correct "is on a the second"
to read -- is on the second --

Signed and Sealed this
Twenty-first Day of April, 2015

Michelle K. Lee

Michelle K. Lee
*Director of the United States Patent and Trademark Office*